US006139440A

United States Patent [19]

Taylor

[11] Patent Number: 6,139,440

[45] **Date of Patent: *Oct. 31, 2000**

[54] CARTRIDGE HOLDER FOR A BALLISTIC IMPELLER GOLF CLUB

[75] Inventor: Roy H. Taylor, Fremont, Calif.

[73] Assignee: Swingless Golf Corporation, Fremont, Calif.

[ * ] Notice: This patent is subject to a terminal disclaimer.

[21] Appl. No.: 08/991,653

[22] Filed: Dec. 17, 1997

[51] Int. Cl.[7] ..... A63B 69/36

[52] U.S. Cl. ..... 473/131; 473/282; 473/329

[58] Field of Search ..... 473/131, 282, 473/324, 333, 334, 336, 337, 338, 339, 345, 350; 89/155, 191.01

[56] References Cited

U.S. PATENT DOCUMENTS

| | | | |
|---|---|---|---|
| 769,939 | 9/1904 | Clark . | |
| 1,739,467 | 12/1929 | Klutho . | |
| 4,170,357 | 10/1979 | Greer . | |
| 5,522,594 | 6/1996 | Taylor et al. | 473/131 |

FOREIGN PATENT DOCUMENTS 1181539 6/1959 France .

OTHER PUBLICATIONS

Ahern, Gene, comic strip, *Times–Union*, p. 31 (Apr. 20, 1956).

*Primary Examiner*—William M. Pierce
*Attorney, Agent, or Firm*—Kenneth C. Brooks

[57] ABSTRACT

A cartridge holder for a ballistic impeller golf-club of the type having a piston and a explosive charge disposed within the head of the golf club. The piston is adapted to travel outwardly from the club head in response to a rapidly expanding gas produced by the explosive charge. A golf-ball, disposed proximate to the club, is struck by the piston, thereby causing the golf-ball to travel a predetermined distance. The cartridge holder is adapted to be rotatably disposed on the golf club to rotated about an axis of symmetry with a plurality of cartridges retained by the cartridge holder so as to produce a rapidly expanding gas along a direction transverse to the axis of symmetry.

20 Claims, 20 Drawing Sheets

CARTRIDGE HOLDER FOR A BALLISTIC IMPELLER GOLF CLUB

TECHNICAL FIELD

The present invention pertains to the field of golf clubs. More particularly, the present invention pertains to a improved cartridge holder ideally suited for use with a ballistic impeller golf club.

BACKGROUND OF THE INVENTION

There are many types of golf clubs for directing a ball along the course of play. From a physics standpoint, clubs are used to impart a force upon the ball resulting from a transfer of kinetic energy from the club to the ball. The kinetic energy developed in the club results from a user standing upright, raising the club above the shoulder and swinging downward toward the ball, resting upon the ground or a tee. The amount of kinetic energy required is dependent upon the distance the ball must travel, which often varies. To that end, various clubs are available which enable a user to provide the requisite amount of kinetic energy to the ball. However, some distances often pose a significant challenge to certain individuals who might otherwise be capable of participating in golf. Many prior art attempts have been made to overcome this problem by amplifying the kinetic energy supplied by the club.

U.S. Pat. No. 769,939 to Clark discloses a golf club which uses a spring in a club head to add additional energy imparted by the club to a ball. The energy stored in the compressed spring is released by impact with the ball. In this manner, the ball travels further than the ball would otherwise travel if a conventional club is used. The practical success of this concept is limited since the peak energy release of the spring and contact with the ball must occur simultaneously, or precisely in phase, to achieve optimum results. Additionally, this design makes the club heavier, thereby increasing the difficulty of striking the ball accurately on the club's "sweet spot", which is more important than additional force in obtaining more distance.

French Pat. No. 1,181,539 to Celestin discloses a golf club which uses an explosive charge in a club head to add additional energy to the swing of the club. The club disclosed by Celestin is swung against the ball. The impact causes a piston having an attached firing pin to contact an explosive charge in the head of the club. The charge causes the piston to move outwardly toward the ball, impelling the ball away from the club. Again, the practical success of this concept is limited since the peak energy release of the explosive charge and contact with the ball must occur simultaneously, or precisely in phase, to achieve optimum results. Additionally, the "sweet spot" on the Celestin club is difficult to strike because the striking surface of the club is small and convex. Therefore, the accuracy of the club is likely to be very poor.

A drawback with the aforementioned devices is that each requires the user to swing the club, which results in a substantial amount of twisting motion on the spine. While such a motion is typically not difficult for a person in average health, or better, others may find the motion difficult, if not, debilitating.

A prior art attempt to impart kinetic energy upon a ball without swinging is disclosed in U.S. Pat. No. 5,522,594 to Taylor et al., which discloses a ballistic impeller golf club. The Taylor invention includes a golf club having a hollow head with a front face. An explosive charge is disposed in the hollow head. A strike plate is integrally formed with a piston.

The front face includes an aperture through which the piston is received so that the strike plate rests against the front race face in a retracted position. One end of a handle is attached to the club head, with the remaining end having a trigger mechanism attached thereto. A firing mechanism is disposed within the handle, with the trigger mechanism attached to one end and a firing pin attached to the remaining end. The firing pin is operably connected to the explosive charge. The charge is in fluid communication with the piston. Upon pulling the trigger mechanism, the firing pin strikes the charge, causing gases to expand within the head, pushing the piston outwardly. The kinetic energy of the expanding gas is imparted upon a ball resting in front of the strike plate. A retractor spring is connected to the piston to retract the same after the gases have exhausted from the head. While the Taylor invention greatly reduces the need to subject the spine to twisting motions while playing golf, it is cumbersome to re-load the golf club for successive discharge of explosive charges.

What is needed, therefore, is a system that facilitates re-loading of a ballistic impeller golf club.

SUMMARY OF THE INVENTION

The present invention features a ballistic impeller golf-club that has a cartridge holder adapted to be rotatably disposed on the golf club to rotated about an axis of symmetry with a plurality of cartridges retained by the cartridge holder so as to produce a rapidly expanding gas along a direction transverse to the axis of symmetry. To that end, the cartridge holder includes a body having a periphery surface and a central cavity, formed radially and symmetrically about an axis of symmetry, defining an inner surface disposed opposite to the periphery surface. A plurality of ducts are formed in the body, each of which has a longitudinal axis that extends transverse to the axis of symmetry an opening formed in the periphery surface and an orifice formed in the inner surface.

DESCRIPTION OF SPECIFIC EMBODIMENTS

Figure 1:
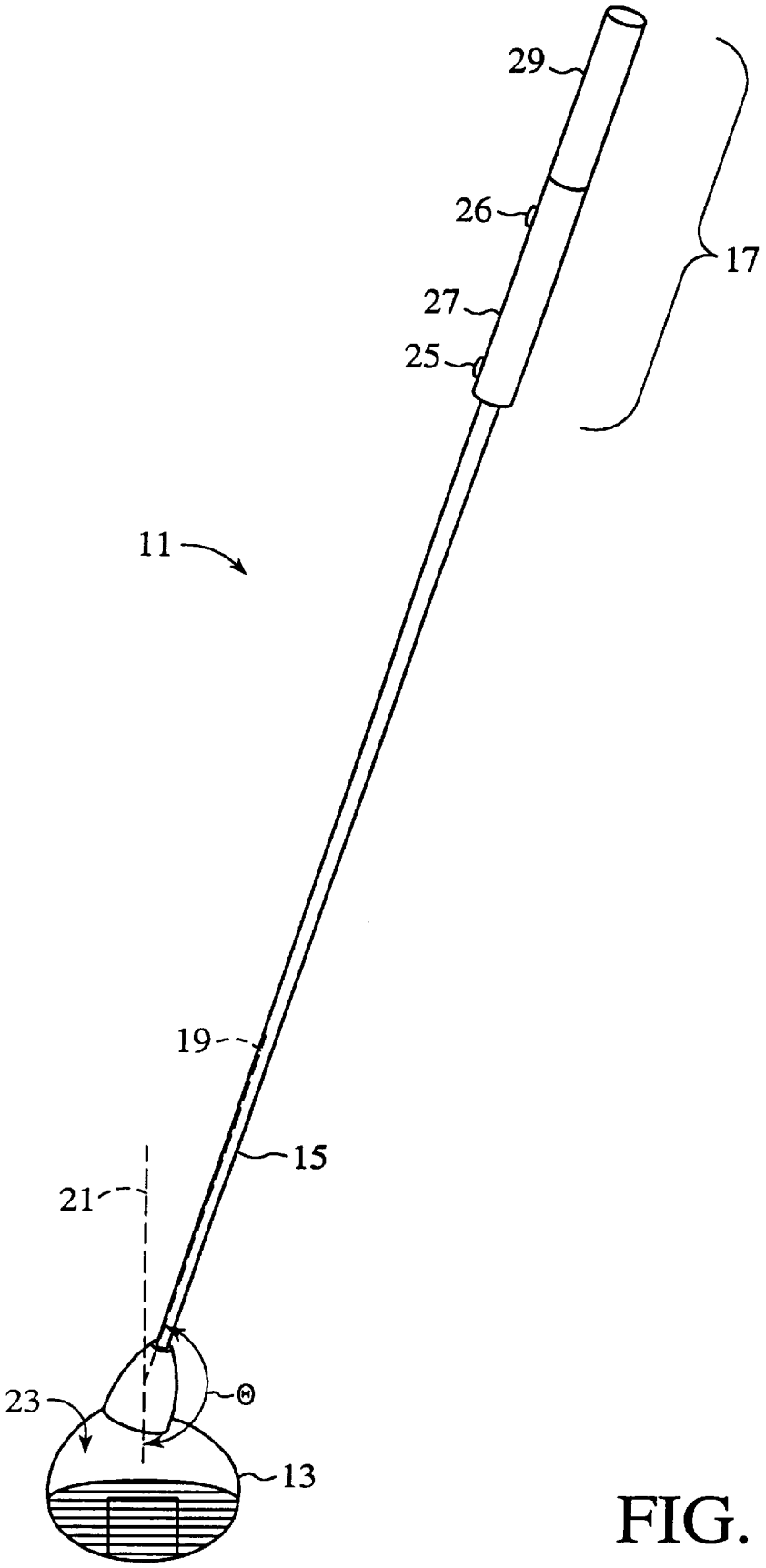
FIG. 1 is a perspective view of the present invention.

Referring to FIG. 1, a golf club 11 includes a club head 13 and a hollow shaft 15 extending from the club head 13, terminating in a handle assembly 17. Hollow shaft 15 includes a central axis 19 and extends from club head 13, with central axis 19 forming an angle with respect to a vertical 21 to a top surface 23 of club head 13. Handle assembly 17 includes trigger 25 and safety 26 buttons, as well as rubberized sheaths 27 and 29.

Referring to FIGS. 1, 2, 3 and 4, club head 13 is shown as having a muzzle portion 31 and a breech portion 33. Muzzle portion 31 includes a body 32 having a strike plate 35 disposed at one end, with a cylindrical housing 37 extending from the opposing end of muzzle portion 31, terminating in a tapered portion 39 having an injection port 41. Typically, the tapered portion 39 includes a side surface 39*a* which has A conical shape and forms an angle Φ with respect to a center axis 34*b*, about which the tapered portion 39 is centered. Breech portion 33 extends from a end 43, terminating in an opening 45, defining A chamber 47. An end of hollow shaft 15, opposite to handle assembly 17, is attached to breech portion 33 proximate to end 43. Chamber 47 is adapted to encapsulate cylindrical housing 37. To securely affix muzzle portion 31 to breech portion 33, a pair of detents 49 extend from cylindrical housing 37. Chamber 47 includes complementary grooves, one of which is shown at 51, in which detents 49 are received when club head 13 is placed in a final seating position, shown more clearly in FIGS. 2 and 3.

Referring again to FIGS. 2 and 3, typically club head 13 is placed in the final seating position by aligning detents 49 with the complementary grooves 51 and rotating muzzle portion 31 ¼ revolution with respect to breech portion 33 until detents 49 rest against groove stop 52. Muzzle portion 31 may be decoupled from breech portion 33 by reversing the aforementioned procedure. This facilitates disassembling club head 13, which eases cleaning of the same, discussed more fully below.

Figure 2:
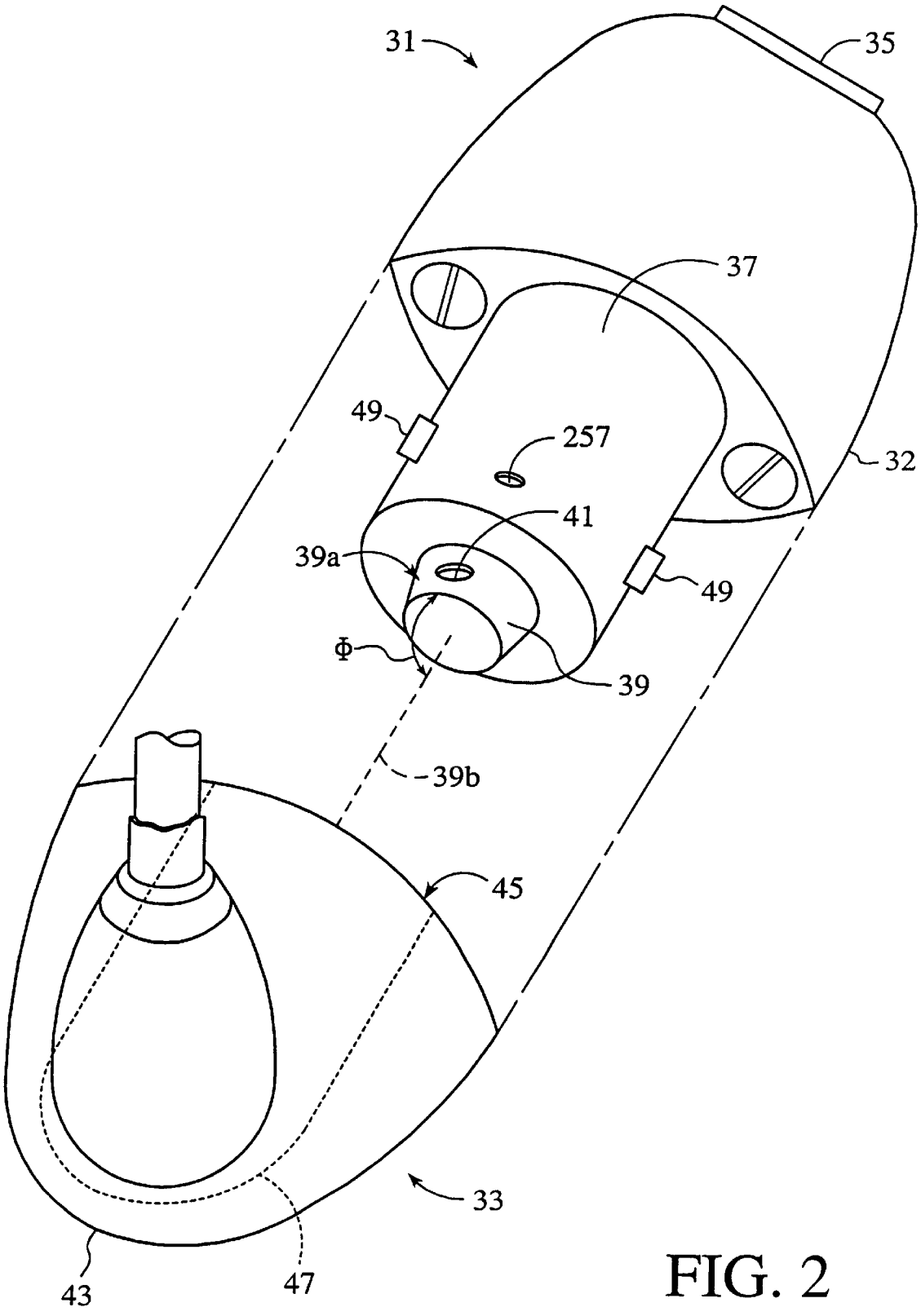
FIG. 2 is a exploded perspective view of the club head shown in FIG. 1, decoupled into a muzzle portion and a breech portion.
Figure 4:
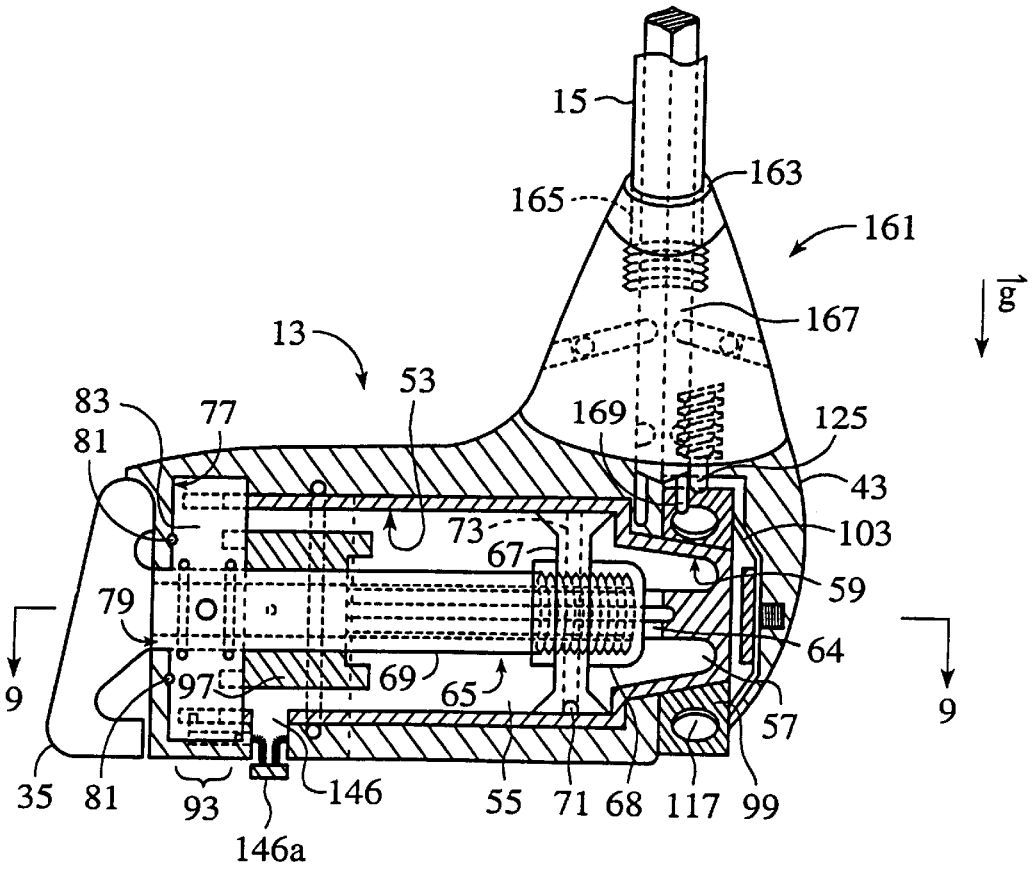
FIG. 4 is a side cross-sectional detailed view showing the internal mechanisms of the muzzle portion and the breech portion shown above in FIGS. 1–3.

Referring to FIGS. 2 and 4, club head 13 is shown in the final seating position, with an inner surface 53 of cylindrical housing 37 defining a piston cylinder 55. A blast chamber 57 is defined by an inner surface 59 of tapered portion 39, which places piston cylinder 55 in fluid communication with injection port 41. Piston cylinder 55 extends from blast chamber 57 and terminates in an orifice 61 which has a periphery including two latch members 63 protruding therefrom, seen more clearly in FIG. 5.

Referring again to FIG. 4, a radial orientation shaft 64 and a piston 65 are each disposed within piston cylinder 55. One end of shaft 64 is fixedly attached to an interior of tapered portion 39 and extends along a longitudinal axis of piston cylinder 55, with the remaining end floating free. Piston 65 includes a hollow chamber 66 through which shaft 64 passes, with piston 65 disposed about shaft 64 to move along the longitudinal axis of piston cylinder 55. Typically, shaft 64 extends through piston 65 the necessary distance to maintain mechanical connection with piston 65 during normal movement of piston 65 through piston cylinder 55. Piston 65 is disposed about shaft 64 to maintain a fixed radial orientation within piston cylinder 55. To that end, hollow chamber 66 has a cross-section complementary to the cross-section of shaft 64 with the aforementioned cross-sections being keyed so that piston 65 does not rotate about shaft 64.

Piston 65 includes a piston head 67, a starter head 68 and a piston rod 69. Piston rod 69 extends from piston head 67 and terminates in strike plate 35. Piston head 67 is positioned between starter head 68 and piston rod 69. Piston 65 is orientated within piston cylinder 55 so that piston head 67 is disposed between piston rod 69 and blast chamber 57. Piston head 67 typically has a shape complementary to the shape of piston cylinder 55. Piston head 67 is formed to provide a gas-check so that a fluid-tight seal is present between inner surface 37 and piston head 67. Strike plate 35 is attached to an end of piston rod 69 opposite to piston head 67. Although strike plate 35 maybe attached to piston rod 69 with steel pins or screws (not shown), it is preferred that the two are integrally formed, with strike plate 35 forming an angle in the range of 10–30° with respect to a direction of gravity g.

Figure 5:
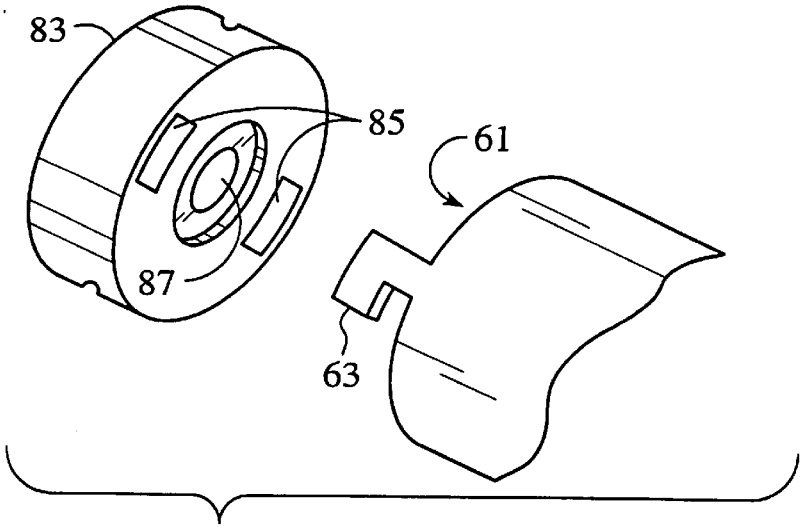
FIG. 5 is a detailed perspective view of a locking ring and latch members associated with the muzzle portion shown above in FIG. 4.
Figure 6:
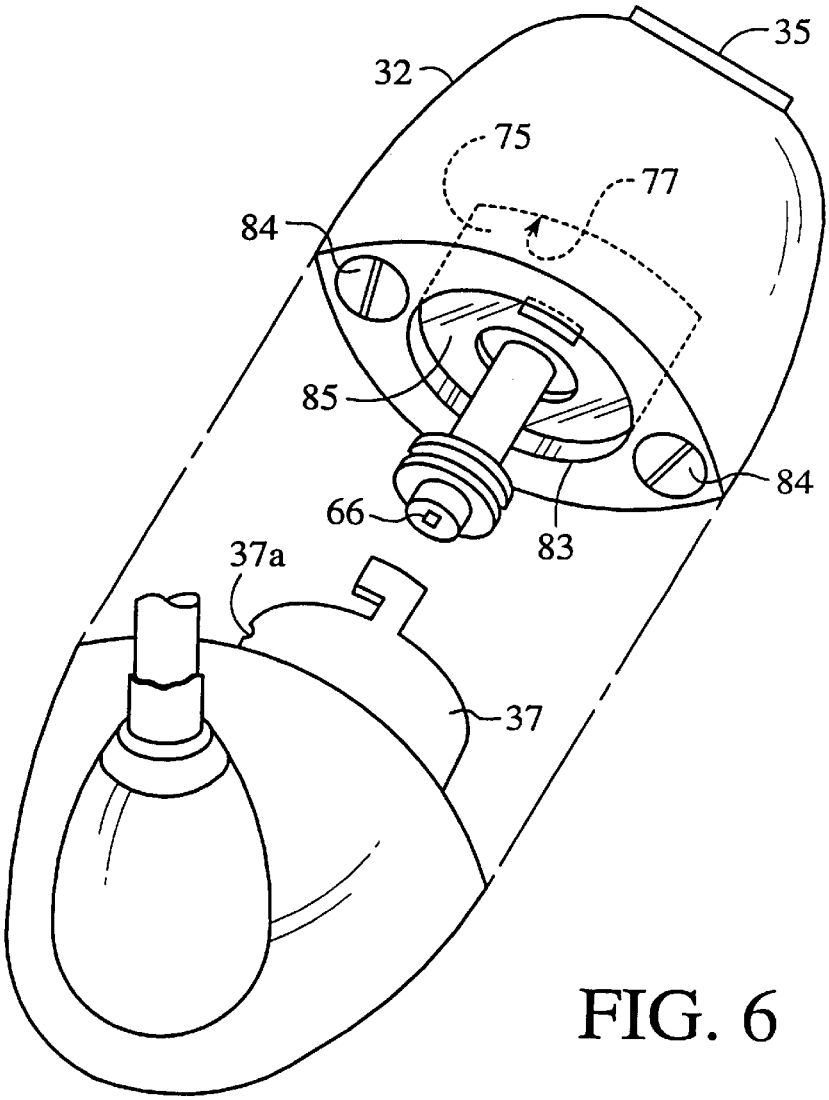
FIG. 6 is a exploded perspective view showing the decoupling of a cylindrical housing from the body of the muzzle portion shown above in FIGS. 4 and 5.
Figure 7:
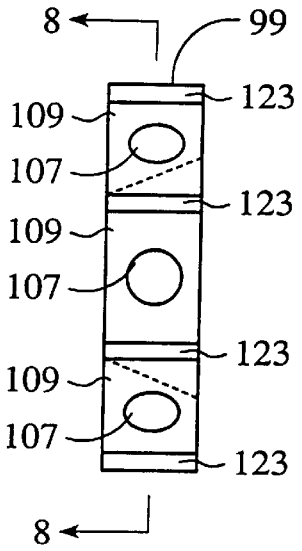
FIG. 7 is a side detailed view of a cartridge holder shown in FIG. 4.
Figure 8:
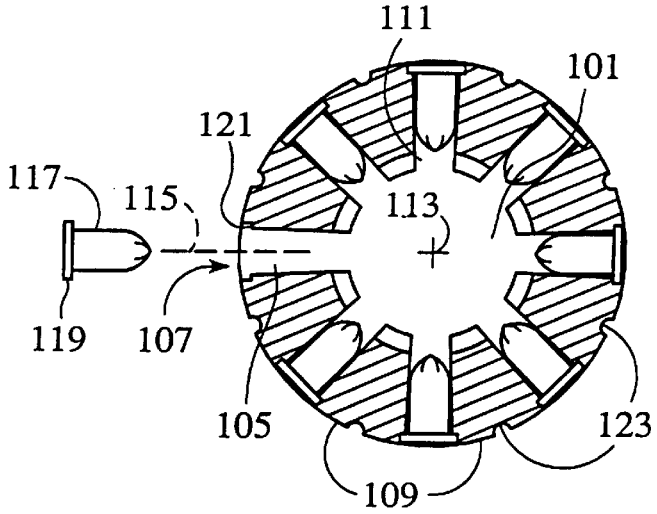
FIG. 8 is a cross-sectional view of the cartridge holder shown in FIG. 7, taken along lines 8—8.

Referring to FIGS. 4, 5 and 6, body 32 has a circular recess 75 with a first major surface 77. A passageway 79 extends from first major surface 77, terminating external to club head 13. A gasket 81 is disposed on first major surface 77, about the perimeter of passageway 79. A locking ring 83 is fixedly secured within recess 75 via screws 84, wedging gasket 81 against first major surface 77 forming a fluid-tight seal therebetween. Locking ring 83 includes two or more spaced apart catch apertures 85, each of which is adapted to receive one of the latch members 63, and a central throughway 87 which aligns with passageway 79. Piston rod 69 passes through both throughway 87 and passage 79, with strike plate 35 disposed on a side of body 32, opposite to locking ring 83. A sealing means 93 is disposed within throughway 87 to form a fluid tight seal between piston rod 69 and locking ring 83. Disposed within muzzle portion 31, about the perimeter of throughway 87, is a marshmallow spring 97. Marshmallow spring 97 extends from muzzle portion 31 into piston cylinder 55, with piston rod 69 passing through the marshmallow spring 97.

Figure 3:
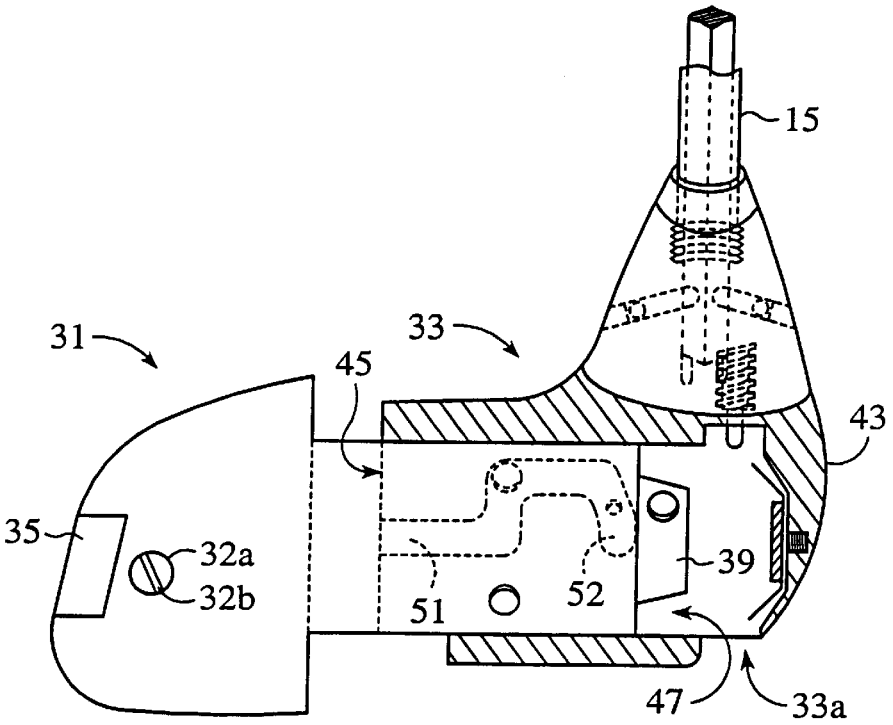
FIG. 3 is a side partial cross-sectional view of the club head with the breech portion for open loading of the club head.

Referring to FIGS. 3 and 6, the cylindrical housing 37 is attached to body 32 by inserting latch members 63 into catch apertures 85 and rotating the cylindrical housing 37 and body 32 in opposite directions, thereby forming muzzle portion 31. An advantage with having a removable cylindrical housing 37 is that it facilitates cleaning of the golf club 11 in the field. Typically, the expanding gas employed leaves a residue that may cause the piston to bind after repeated use. This residue may be easily removed by de-coupling the components for cleaning.

Referring to FIGS. 3, 6, 20 and 21, the relative position between cylindrical housing 37 and body 32 is maintained by an interference fit achieved by selectively coupling bolt 32 at housing 37. Specifically, bolt 32*a* includes a slot 32*b* at on end and a plurality of threads 32*c* at the opposing ends. Extending between slot 32*b* and threads 32*c* is a shaft having an arcuate recess 32*d*. The radius of curvature of recess 32*d* matches the radius of curvature of housing 37. Bolt 32*a* is inserted into body 32 so that slot 32*b* is accessible outside of club head 13. Threads 32*c* fit into A threaded hole in body 32, not shown. Cylindrical housing 37 includes a groove 37*a* that faces bolt 32*a*. To allow rotational movement between body 32 and housing 37, bolt 32*a* is moved so that recess 32*d* faces groove 37*a*. To fix the position of body 32 with respect to cylindrical housing 37, bolt 32*a* is rotated so that recess 32*d* faces away from groove 37*a*. In this position, bolt 32*a* forms an interference fit with housing 37.

Referring to FIGS. 3, 4, 7 and 8, a rotor 99 is shown as configured to be disposed between piston cylinder 55 and end 43, when head 13 is in the final seating position. Specifically, rotor 99 includes a central cavity 101 which receives tapered portion 39. The interior surface of central cavity 101 matches the contour of tapered portion 39. Rotor 99 is resiliently biased against tapered portion 39 by spring member 103 positioned on end 43. In this fashion, the spring member 103 wedges rotor 99 onto tapered portion which reduces noise and power loss by preventing rapidly expanding gases from leaking between the rotor 99 and the conical surface 39*a*. Specifically, the spring force to which the rotor 99 is subjected forces the rotor 99 tightly against the conical surface 39*a*, forming a substantially fluid-tight seal therebetween. By preventing gases from leaking between the tapered portion 39 and the rotor 99, a great amount of rapidly expanding gas is directed through the injection port 41, thereby increasing the forced exerted upon the piston head 67. An added advantage is that upon rotation of the rotor 99 about the tapered portion 39, any residue that is present proximate to the injection port 41 is scraped away by the friction between the rotor 99 and the conical surface 39.

A plurality of ducts 105 extend from an opening 107 disposed in a periphery 109 of rotor 99, terminating in an orifice 111 proximate to central cavity 101. Each duct 105 tapers approximately 3° between from opening 107 and orifice 111, with opening 107 having a greater area than orifice 111. Rotor 99 is radially symmetric about axis 113, with each of the ducts 105 having a longitudinal axis 115 extending transversely to axis 113. Each duct 105 is configured to receive a receptacle 117 adapted to produce a rapidly expanding gas. Although any type of rapidly expanding gas containing receptacle may be employed, it is preferred that receptacle 117 is a blank-charge of the type typically employed in blank-guns. Typically, receptacle 117 is a cartridge housing a smokeless powder and a primer. Receptacle 117 may be either rim fire or rimless fire. Receptacle 117 is disposed within a duct 105 so that a primer portion 119 of receptacle 117 is disposed proximate to periphery 109. Duct 105 includes a counter sunk portion 121 adapted to receive primer portion 119, with receptacle 117 mounting flush with respect to periphery 109. In this fashion, expanding gases from Receptacle 117 are directed toward axis 113 upon detonation of receptacle 117.

Referring to FIGS. 1, 2, 3, 4, 7 and 8, in the final seating position, rotor 99 is pivotally disposed about tapered portion 39 to rotate about axis 113. A portion of periphery 109 extends through an opening 33*a* in breech portion 33, opposite hollow shaft 15, and is accessible to a user of golf club 11. Essential to the proper operation of golf club 11 is ensuring that each orifice 111 of rotor 99 is selectively aligned with injection port 41 so that a maximum quantity of expanding gas may pass therethrough into blast chamber 57. To that end, rotor 99 includes a plurality of dimples 123 positioned in periphery 109. Dimples 123 are arranged to form an interlocking fit with a plunger 125 located proximate to end 43, upon Muzzle portion 31 and breech portion 33 being fixed in the final seating position.

Referring to FIGS. 2, 4, 7 and 8, plunger 125 is resiliently disposed to project toward dimples 123 and moves transversely to axis 113. In this fashion, rotor 99 may be pivoted by hand so that upon alignment of each orifice 111 with injection port 41, plunger 125 is received within a dimple 123, forming an interference fit therewith. When receptacle 117 is detonated to produce expanding gas, a great amount of pressure is developed in blast chamber 57 which projects piston head 67 toward locking ring 83, thereby moving strike plate 35 away from club head 13. Marshmallow spring 97 is adapted to decelerate piston head 67 upon impact.

Figure 9:
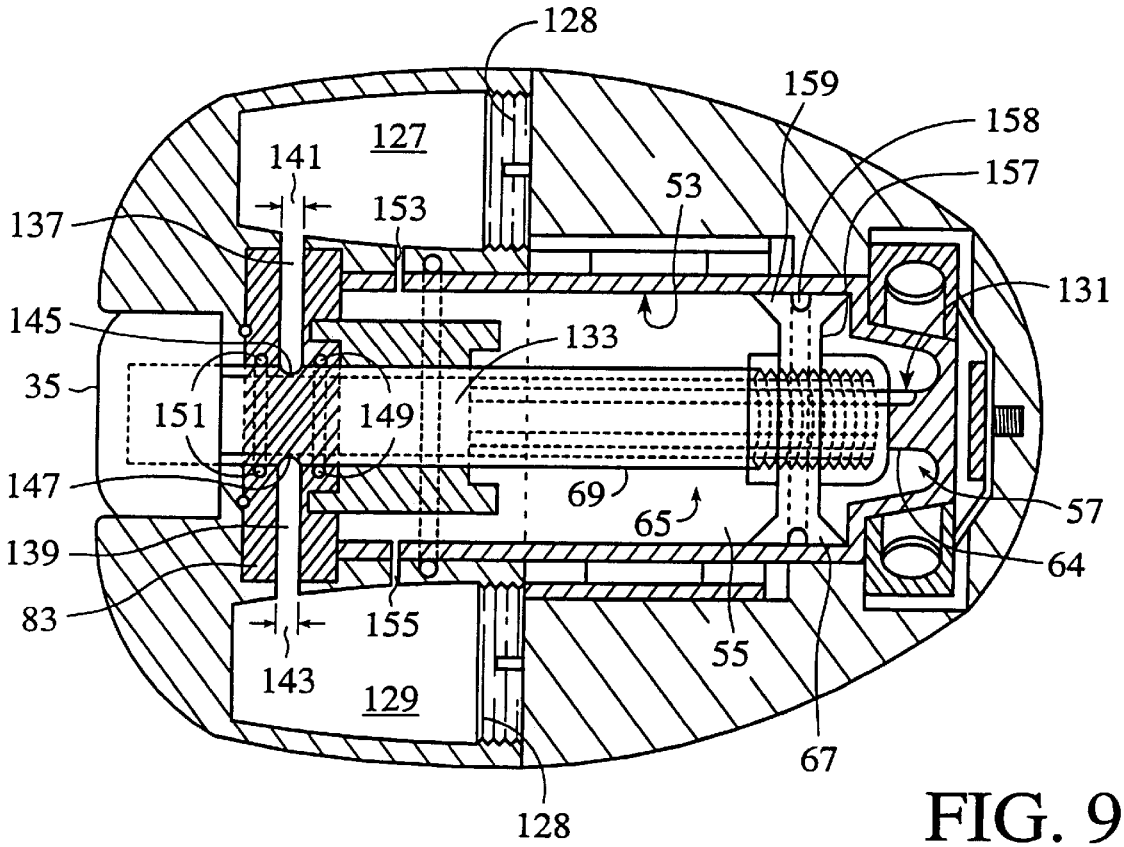
FIG. 9 is a bottom cross-sectional view of the club head shown in FIG. 4, taken along lines 9—9.

Referring also to FIGS. 5 and 9, piston 65 is returned to an initial seating position, with piston head 67 disposed proximate to blast chamber 57, by means of reverse pressurization. Specifically, a pressure reversing pneumatic retraction system is employed to return piston 65 to the initial seating position. The pneumatic retraction system includes two feed chambers 127 and 129, each of which is in fluid communication with blast chamber 57 by means of channel 131 in shaft 64 that is disposed in piston rod 69. Preferably, feed chambers 127 and 129 are integrally formed with body 32 of muzzle portion 31. One end of each chamber is sealed with a pressure cap 128. Feed chambers 127 and 129 are placed in opposing relation on opposite sides of piston cylinder 55, proximate to strike plate 35.

Shaft 64 includes a feed orifice 131 positioned proximate to blast chamber 57. A feed channel 133 is formed in piston rod 69 and is in fluid communication with feed orifice 131 located in shaft 64. Two inlet channels 137 and 139 are disposed in locking ring 83, with each inlet channel 137 and 139 extending through locking ring bearing 87, terminating proximate to a periphery of locking ring 83. Each inlet channel 137 and 139 is in fluid communication with a feed chamber 127 and 129 by a coupling tube 141 and 143, respectively. Feed channel 133 is in fluid communication with inlet channels 137 and 139 via outlet orifices 145 and 147, respectively.

As discussed above, locking ring 83 forms a fluid tight seal between piston rod 69 and locking ring 83 by having sealing means 93 attached thereto. Sealing means 93 includes a first gasket 149 and a second gasket 151. First gasket 149 forms a fluid-tight seal between piston cylinder 55 and inlet channels 137 and 139. Second gasket 151 forms a fluid-tight seal between an exterior of muzzle portion 31 and inlet channels 137 and 139.

In operation, high pressure expanding gas enters blast chamber 57 through injection port 41 and impinges upon starter head 68 and piston head 67. A portion of the gas entering blast chamber 57 passes through feed orifice 131 and into feed channel 133 via feed tube 135. Gas entering feed channel 133 passes through outlet orifices 145 and 147 and into feed chambers 127 and 129. Specifically, gas exiting through outlet orifice 145 passes into feed chamber 127 via inlet channel 137 and coupling tube 141; gas exiting through outlet orifice 147 passes into feed chamber 129 via inlet channel 139 and coupling tube 143. As piston head 67 moves toward marshmallow spring 97, fluid communication between outlet orifices 145 and 147 and inlet channels 137 and 139, respectively, terminates. This, in turn, terminates fluid communication between feed channel 133 and feed chambers 127 and 129.

More particularly, an outer surface of piston rod 69 covers one end of inlet channels 137 and 139, with first and second gaskets 149 and 151 effectively sealing gas in feed chamber 127 and 129. Residual gas remaining in feed chamber 133 and piston cylinder 55 is vented into an ambient outside of club head 13, upon piston rod 69 extending away from muzzle portion 31 a sufficient distance to place outlet orifices 145 and 147 in fluid communication with the ambient. Additional venting may be achieved by a bottom exhaust port 146 in fluid communication with piston cylinder 55. Typically, bottom exhaust port 146 includes a cover 146*a* resiliently disposed to rest against club head 13. This creates a pressure differential within club head 13, with the gas pressure present in feed chambers 127 and 129 being greater than the gas pressure in piston cylinder 55.

To take advantage of the aforementioned pressure differential, outlet ports 153 and 155 place piston cylinder in fluid communication with feed chambers 127 and 129, respectively. Gas slowly bleeds through outlet ports 153 and 155, creating a pressure build up in the portion of piston cylinder 55 located between locking ring 83 and piston head 67. This returns piston 65 to the initial position, to begin a new cycle.

As discussed above, problems encountered with use of the aforementioned expanding gas concerns the build-up of residue on inner surface 53 which defines piston cylinder 55. To that end, it is preferred that piston head 67 is designed so that a central portion 157 of the same, proximate to shaft 64, be substantially thinner than a peripheral portion 159, positioned adjacent to inner surface 53. In this fashion, piston head 67 flares outwardly from central portion 157 toward peripheral portion 159, flexing outwardly toward inner surface 53 and forming a seal therewith. This shape creates a vortex which reduces the amount of residue that accumulates between piston head 67 and inner surface 53. Also, a gasket may be disposed within with a half-round groove 158 to form a fluid tight seal between inner surface 53 and piston head 67.

Referring to FIGS. 2, 3, 4 and 8, to detonate one of the receptacles 117, club head 13 also includes a firing pin housing 161 protruding upwardly and slightly outwardly from breech portion 33 opposite to rotor 99, tapering to form a firing pin housing tip 163. A bore 165 extends from pin housing tip 163, terminating proximate to tapered portion 39. A firing index pin 167 is disposed within bore 165 and includes a firing pin 169. Firing pin 169 extends adjacent to plunger 125 and is aligned with one of the receptacles 117 disposed in rotor 99 when plunger 125 is received within one of the dimples 123, as discussed above. Bore 165 is of sufficient size to restrict the movement of index pin 167 to axial motion parallel to an axis of bore 165. Bore 165 may have any cross-section desired, including hexagonal circular or rectangular, with index pin 167 having a complementary shape.

Referring to FIGS. 4, 10, 11, and 12, elongated hollow shaft 15 is fixed at an end of club head 13 opposite to handle assembly 17. Handle assembly 17 includes forward section 171, a rear section 173 and a spring channel 175 running the length of section 171, with rear section 173, which is smaller in diameter than forward section 171, fitting therein. Forward section 171 of handle 17 includes a trigger and safety groove 177, with safety groove 177 having trigger spring slot 179 and trigger slot 181. Rear section 173 includes forward cocking pawl slot 183, and rear cocking pawl slot 185. The diameter of spring channel 175 abruptly narrows, forming firing pin linkage spring shoulder 187, then abruptly widens again, resuming its previous diameter. Firing pin linkage 189 is slidably received in a cylinder 191 and coupled to firing index pin 167. Firing pin linkage 189 is attached to a trigger shoulder 193 and firing pin head 195, each having a larger diameter than firing pin linkage 189. A helical compression firing pin spring 197 is engaged over and around firing pin linkage 189 having one end engaged with trigger shoulder 193 and the other engaged with both a flat washer 199 and an end of firing pin spring housing 175.

Rear section 173 is slidably received in cocking handle sleeve 201. Forward cocking pawl 203 is slidably received in rear member section 173, with forward cocking pawl tab 207 extending through forward cocking pawl slot 183 and attached to cocking handle sleeve 201 by screws 213. Rear cocking pawl 209 is shaped substantially similar to forward cocking pawl 203, having rear cocking pawl tab 211. Rear cocking pawl 209 is slidably received in rear member section 173, with rear cocking pawl tab 211 extending through rear cocking pawl slot 185. Forward cocking pawl 203 and rear cocking pawl 209 are fixed to cocking handle sleeve 201 by means of cocking pawl screws 213. A helical compression cocking handle return spring 215 is received within handle housing 175, with one end engaged with a rear wall 217 of rear section 173 and the other engaged with rear cocking pawl 209. Cocking handle return spring 215 need not be fixedly attached to rear wall 217 of handle or with rear cocking pawl 209, because its inherent spring energy will tend to keep it engaged with these members.

Rubberized sheaths 27 and 29 cover forward member section 171 and cocking handle sleeve 201, respectively, and butt together. Sheath 27 has a hole 219 through which trigger button 25 extends, as well as a slot 221 through which safety button 26 extends.

Trigger mechanism 223 includes trigger member 225 having trigger button 25 attached to the upper surface at the forward end of trigger member 225 and pivot pin 227 which passes through trigger member 225 defining a pivot point. Trigger member 225 is arched slightly so that trigger member lever end 229 engages trigger shoulder 193. Each side of trigger pivot pin 227 is received in pivot holes 231 forward section 171. A helical trigger compression spring 233 is engaged with hollow shaft 15 at one end, with the remaining end engaging Trigger member 225 in substantial proximity to trigger button 25.

A trigger safety mechanism 235 comprises safety member 237 having attached safety slide button 26, and helical safety return spring 239. Safety return spring 239 engages a safety pin 241, at one end, and snap ring 243 at the remaining end. Alternatively, safety return spring 239 is in A bore of safety member 237, with one end of spring 239 engaging a dead end of bore and the remaining end engaging a groove (not shown) in forward section 171.

In cocked position, trigger member lever end 229 is engaged with trigger shoulder 193. Safety member 237 engages trigger member lever 229, preventing release of trigger shoulder 193 and consequently release of firing pin linkage 189.

The firing mechanism is cocked by pulling cocking handle sleeve 201 back away from club head 13. This causes forward cocking pawl 203 to engage firing pin head 195, pulling firing pin linkage 189 away from club head 13 and, therefore, firing index pin 167. Firing pin linkage is moved until trigger shoulder 193 passes trigger member lever end 229. Trigger member lever end 229 is urged downwardly against firing linkage 189 by trigger compression spring 233. Safety member 237 is pushed forward to engage trigger member lever 229, preventing release of trigger shoulder 193. Cocking handle return spring 215 urges cocking handle sleeve 201 back to ready position. In this manner, the compressed springs store potential energy. The potential energy is converted to kinetic energy upon release of safety mechanism 235 and operation of trigger mechanism 223, which causes both the firing pin linkage 189 and the firing index pin 167 to move toward club head 13. In this fashion, firing pin 169 strikes receptacle 117, causing the same to detonate.

Figure 13:
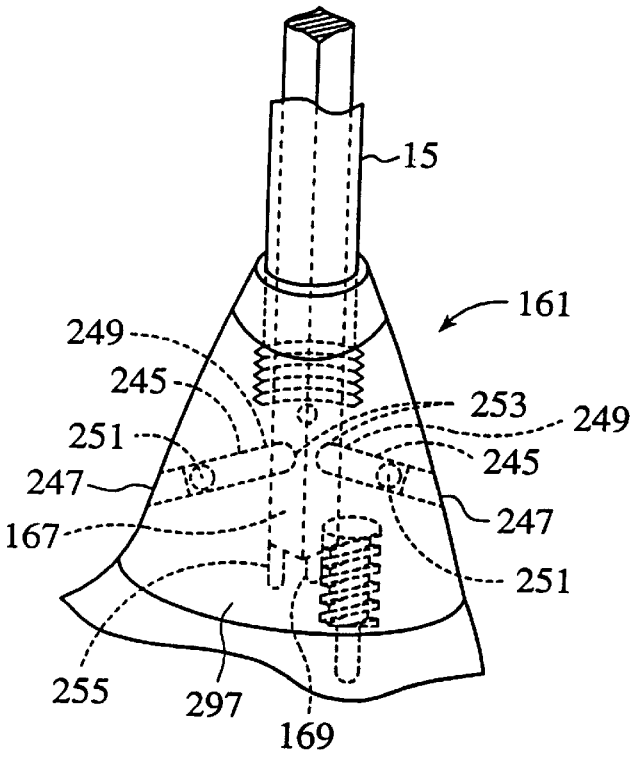
FIG. 13 is a cross-sectional view of a handle-club head interface showing a tilt-safety system, in accord with the present invention.

Referring to FIGS. 4 and 13, although it is not necessary, a tilt safety system is shown as being included in firing pin housing 161. The tilt safety system includes a plurality of bearing races 245 integrally formed with housing 161. Preferably, four races 245 are employed each extending from handle 15 angled toward club head 13 forming an angle Φ with respect to a direction of gravity. Angle Φ is typically in the range of 5 to 15°. In this fashion, each race 245 includes nadir 247 and an apex 249. Each race 245 forms a 90° angle with respect to an adjacent race 245. A bearing 251 is disposed in each race 245 to rotate between nadir 247 and apex 249. Associated with each race 245 is an indent 253 formed in firing index pin 167. Each indent 253 is adapted to receive one of the bearings 251 so that the two hemispheres of one of the bearings 251 simultaneously contacts firing index pin 167 and apex 249 when the angle Φ is between 5 to 15°. The number of bearings 251 that are received within indents 253, at any one point in time, is dependent upon tilt direction and degree of angle. In this fashion, each bearing 251 forms an interlocking feature having an interference fit between firing pin housing 161 and firing index pin 167, thereby preventing the movement of firing pin 169. The tilt safety system is effective in preventing unintended detonation of receptacle 117 when golf club 11 is carried, for example, over a user's shoulder or when held upside down. To remove bearing 251 from indent 253 rear section 173 is pulled away from club head 13 to re-cock firing pin 169.

Referring to FIGS. 2, 4 and 13, an additional safety is provided to ensure detonation of receptacle 117 will not occur unless club head 13 is in the final seating position. To that end, a safety pin 255 is attached to firing index pin 167, extending past firing pin 169. A passage 257 is formed in the cylindrical housing so as to receive safety pin 255 upon Muzzle portion 31 and breech portion 33 reaching the final seating position. If safety pin 255 fails to seat in passage 257 due, for example, to misalignment of muzzle portion 31 with respect to breech portion 33, safety pin 255, being longer than firing pin 169, acts as a standoff. This causes firing pin 169 to fall short of receptacle 117, thereby preventing detonation of the same.

Figure 14:
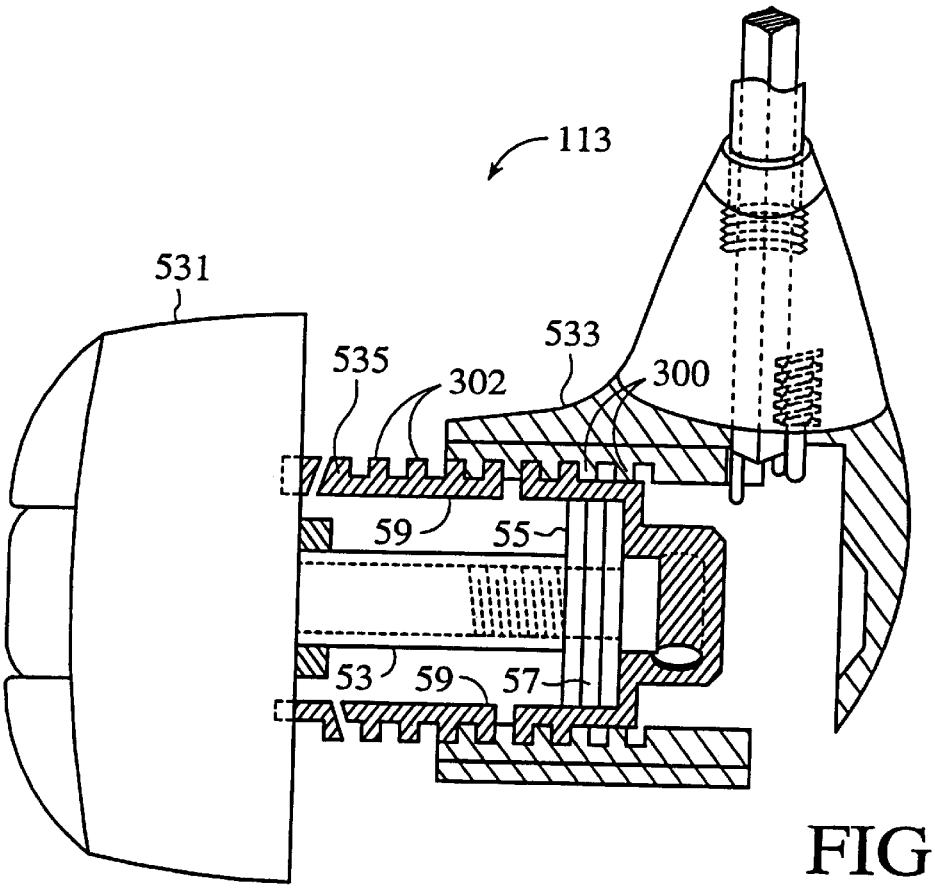
FIG. 14 is an exploded side cross-sectional view of the club head, in accord with an alternate embodiment of the present invention.

Referring to FIG. 14, an alternate embodiment of club head 113 has the features mentioned above with respect to FIGS. 1–13 except that an interior surface of chamber 547, formed in breech portion 533, includes a plurality of threads 300. The outer surface of cylindrical housing 535 of muzzle portion 531 includes a plurality of threads 302 which are adapted to engage threads 300 of chamber 547.

Figure 15:
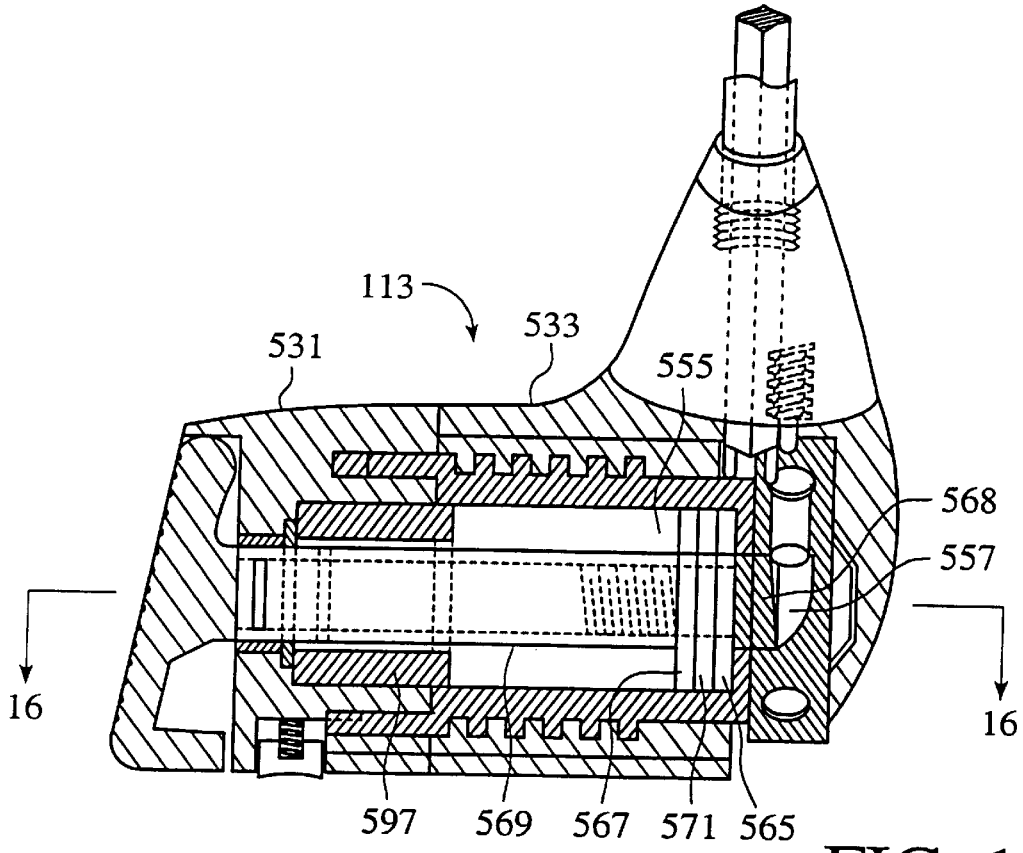
FIG. 15 is a side cross-sectional view of the club head shown in FIG. 14 in a closed position.
Figure 16:
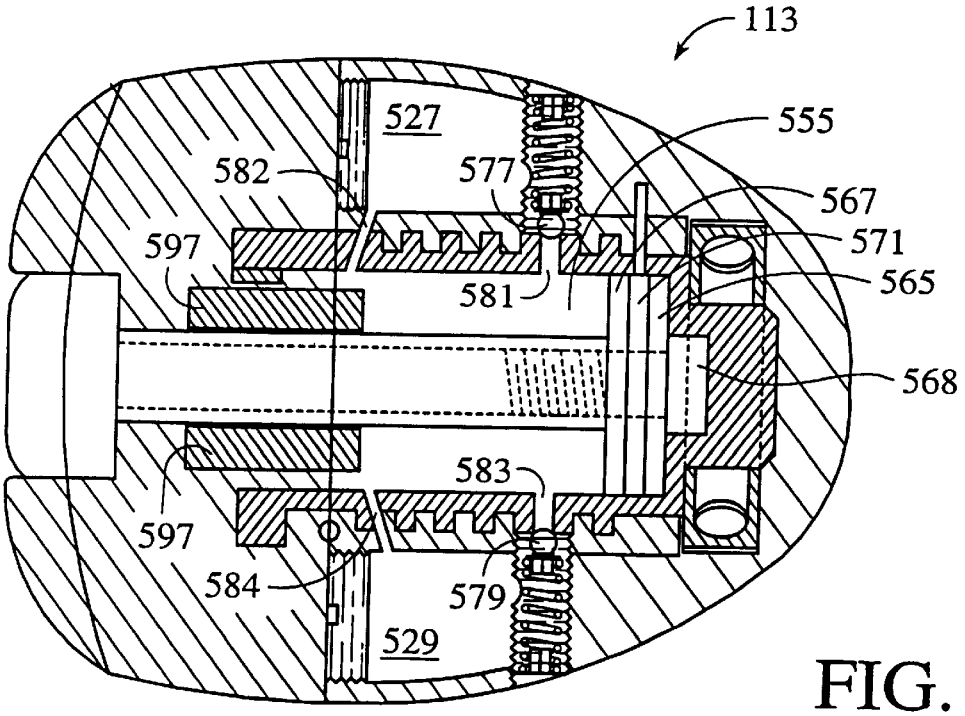
FIG. 16 is a bottom cross-sectional view of the club head shown in FIG. 15, taken along lines 16—16.

Referring to FIGS. 15 and 16, club head 113 is shown with muzzle portion 531 and breech portion 533 in a final seating position. Disposed within piston cylinder 555 is a piston 565 having a piston head 567, starter head 568 and a piston rod 569 which are orientated as discussed above with respect to FIGS. 1–13. Piston head 567 includes a half-round groove 571 circumferentially disposed thereabout. A gasket, such as an O-ring, may be disposed within groove, defining a sealing member. Sealing member has a shape matching a cross-section of piston cylinder 555 to form a fluid tight seal with between piston head 567 and the interior surface of chamber 555.

The retraction system in club head 113 differs from that shown above in that feed chambers 527 and 529 are selectively placed in fluid communication with piston cylinder 555 via check valves 577 and 579. Specifically, feed chamber 527 is selectively placed in fluid communication with piston cylinder 555 via feed channel 581 through check valve 577. Spaced apart from feed channel 581, is an outlet channel 582 placing feed chamber 527 in constant fluid communication with piston cylinder 555. Feed chamber 529 is selectively place in fluid communication with piston cylinder 555 via feed channel 583 through check valve 579. Spaced apart from feed channel 583, is an outlet channel 584 placing feed chamber 529 in constant fluid communication with piston cylinder 555.

During operation, the fluid pressure within piston cylinder 555 and feed chambers 527 and 529 is at equilibrium, with check valves 577 and 579 blocking fluid flow through feed channels 581 and 583, respectively. Upon detonation of receptacle 517, an expanding gas enters blast chamber 557. The expanding gas in blast chamber 557 creates pressure which operates on starter head 568 and piston head 567 causing both to travel away from blast chamber 557 toward marshmallow spring 597. As piston head 567 travels past feed channels 581 and 583, the pressure differential between piston cylinder 555 and feed chambers 527 and 529 causes check valves 577 and 579 to open. The opening of check valves 577 and 579 allows gas to travel from piston cylinder 555 to feed chambers 527 and 529. Upon piston head 567 impacting with marshmallow spring 597, a reverse pressure differential develops with the pressure present in feed chambers 527 and 529 being greater than the pressure present in the portion of piston cylinder located between piston head 567 and blast chamber 557. The reverse pressure differential results from outlet channels 582 and 584 having a substantially smaller cross-sectional area than feed channels 581 and 583. The small cross sectional area allows the gas pressure present in feed chambers 527 and 529 to slowly bleed into the portion of piston cylinder 555 disposed between marshmallow spring 597 and piston rod 567, driving piston 557 to its final seating position.

Figure 17:
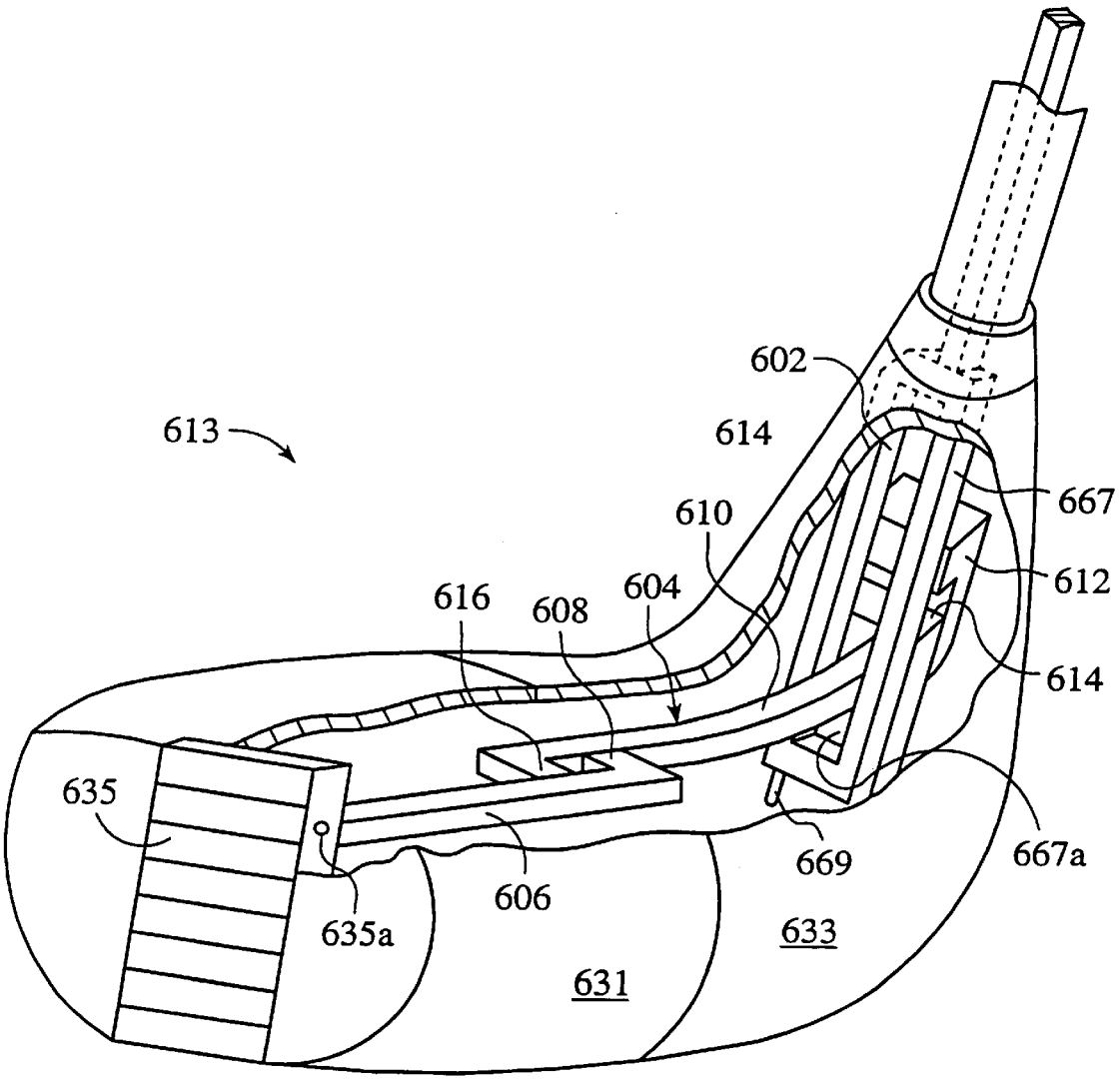
FIG. 17 is a perspective cut-away view of the club head, in accord with a second alternative embodiment.
Figure 18:
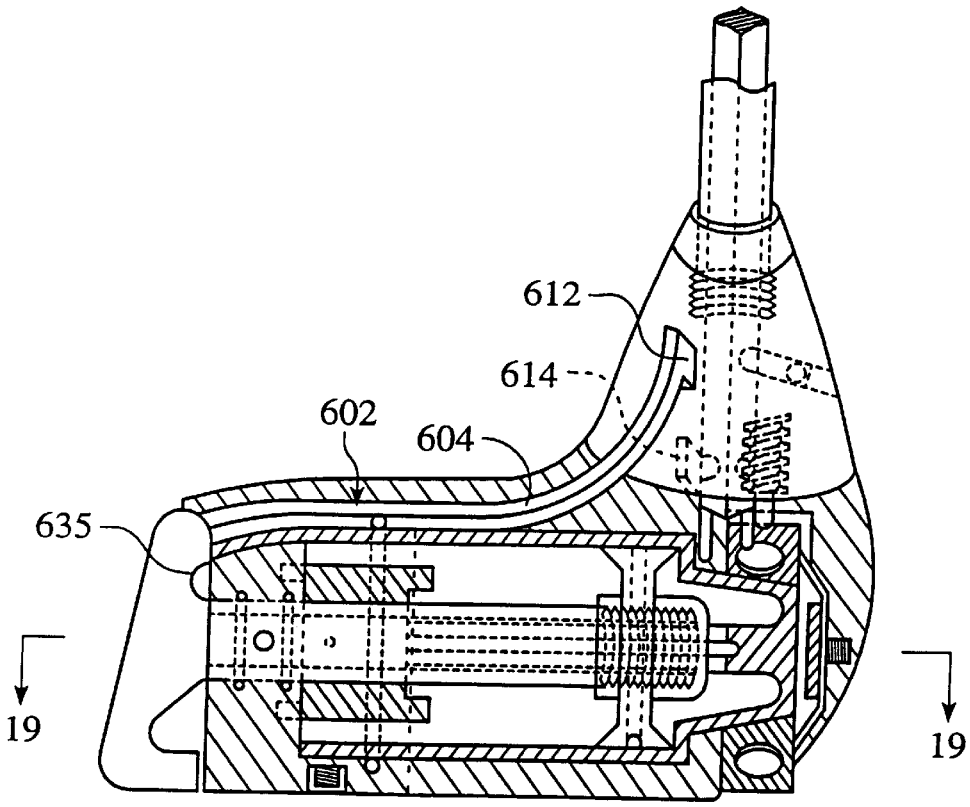
FIG. 18 is a cross-sectional side view of the club head shown in FIG. 17.

Referring to FIGS. 17 and 18, a third embodiment of the club head 613 is shown which may also include the features discussed above with respect to FIGS. 1–13, but includes a passageway 602 disposed between the upper surface 623 and the piston cylinder 655. Disposed within passageway 602 is a flexible lanyard 604. A first section 606 of flexible lanyard 602 is coupled to strike plate 635 by a pin 635*a* and extends therefrom, terminating in a shoulder 608. A second section 610 of flexible lanyard extends from shoulder 608, passing through A slot 667*a* in firing index pin 667, terminates in a dove-tailed groove 612. Firing index pin 667 includes a notch 614 having a shape complementary to the dove-tailed groove 612 and is disposed to receive the same and selectively form an interlocking fit therewith. By having the flexible lanyard pass through the firing index pin 667, the angle, which the flexible lanyard bends is reduced. However, the dove-tailed groove 612 and the notch 614 may be disposed to face the strike plate 635. The opposing end 616 of second section 610 includes a shoulder having a complementary shape to shoulder 608, with end 616 and shoulder 608 selectively forming an interlocking fit.

Figure 10:
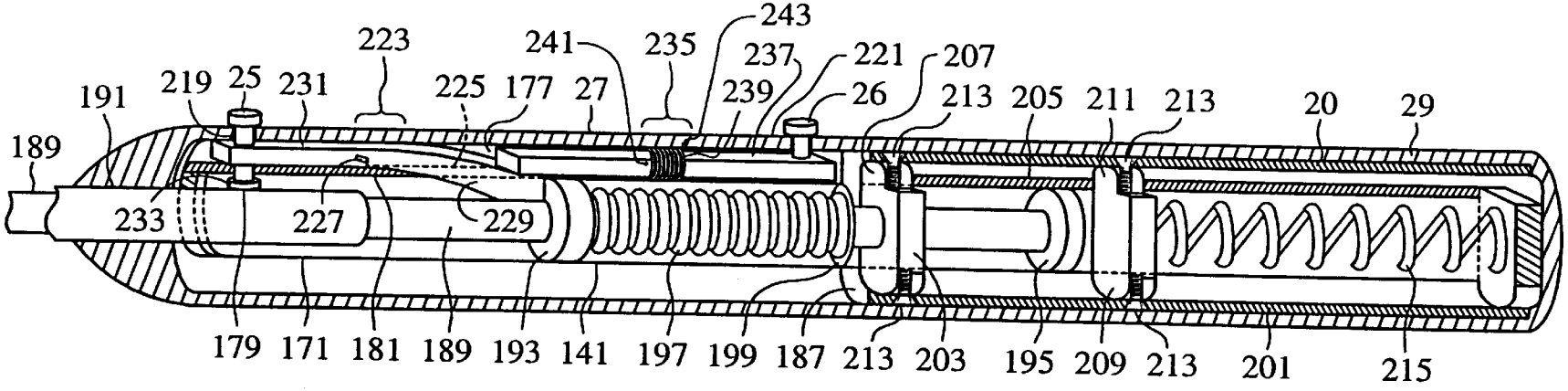
FIG. 10 shows a sectional perspective view of the handle shown in FIG. 1.
Figure 12:
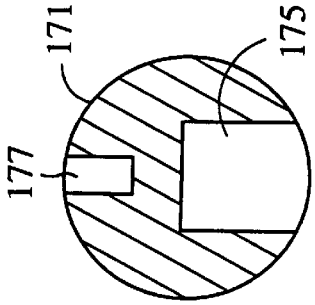
FIG. 12 is a front cut away view of the handle shown in FIG. 11, taken along lines 12—12.
Figure 11:
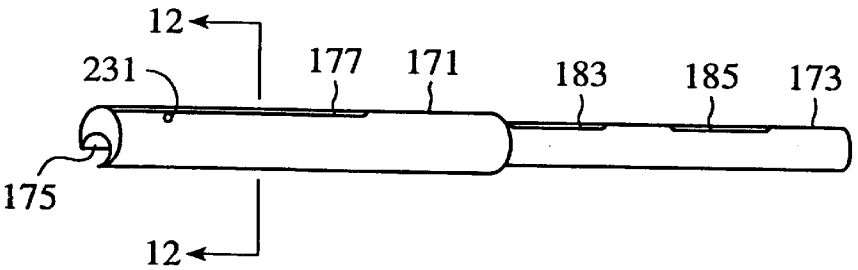
FIG. 11 is a perspective view of the handle shown in FIGS. 1 and 10.

Referring to FIGS. 10 and 17, in operation cocking handle sleeve 210 is pulled away from club head 613, causing rear cocking pawl 203 to slide against firing pin head 195. This causes firing pin linkage 189 and, therefore, firing index pin 667, to move away from club head 613. An interlocking fit between dove-tailed groove 612 and notch 614 causes second section 610 to move away from strike plate 635. This results in end 616 engaging shoulder 608 and moving first section 606 toward firing index pin 667. In this fashion, strike plate 635 is retracted into club head 613. Upon depressing trigger 25, The potential energy in spring 197 is converted to kinetic energy, driving firing pin 669 into receptacle (not shown). As the firing pin 669 thrusts forward into club head 613, the second section 610 is left in a retracted position. Upon detonation of the receptacle (not shown), strike-plate 635 is driven to its extended position. The interlocking fit of shoulder 608 with end 616 extends lanyard 604 into an extended position. In the extended position, dove-tailed groove 612 comes into contact with notch 614 so that strike-plate 635 may once again be placed in the retracted position, as discussed above.

Figure 19:
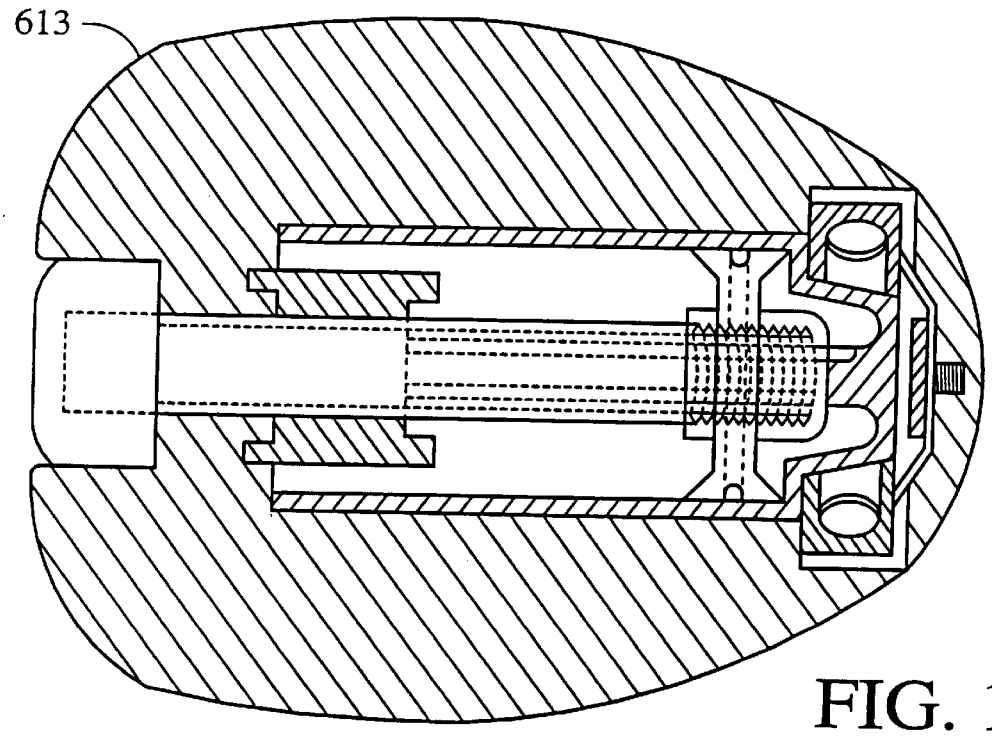
FIG. 19 is a bottom cross-sectional view of the club head shown in FIG. 18, taken along lines 19—19.
Figure 21:
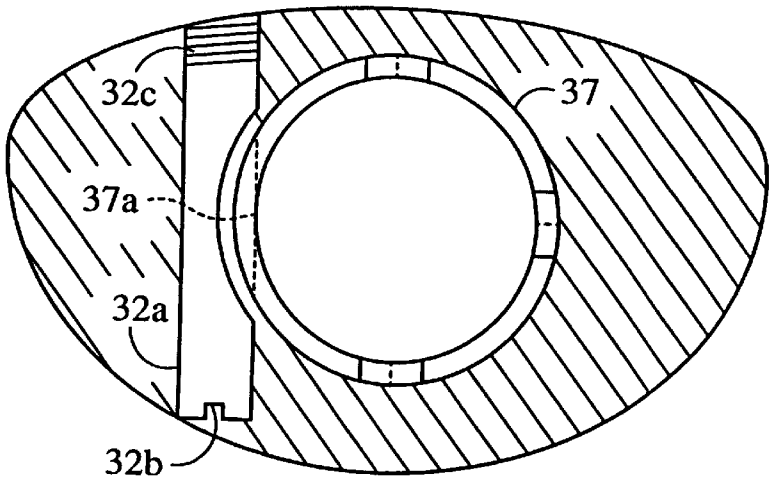
FIG. 21 is a detailed plan view of the latch mechanism shown in FIG. 20 in an unlocked position.
Figure 20:
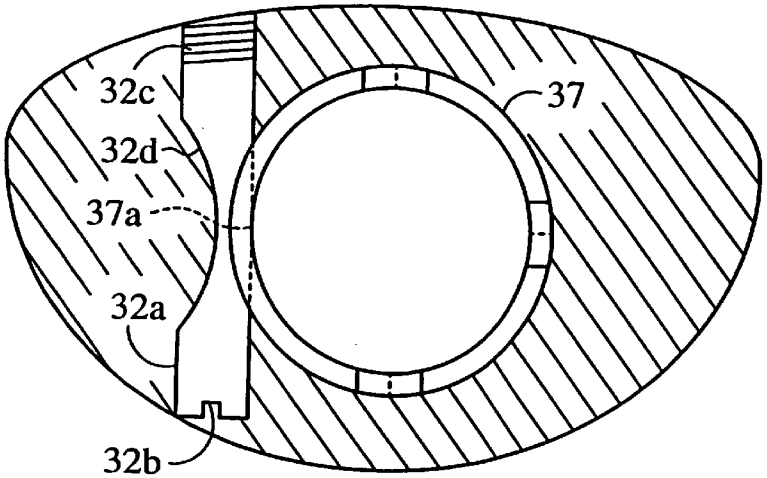
FIG. 20 is a detailed plan view of a latch mechanism shown in FIG. 3 in a locked position.

An advantage with employing lanyard 604 to retract strike-plate 635 is that club head 613 is of much simpler design, shown more clearly in FIG. 19. This lowers manufacturing costs, by abrogating the need to form the aforementioned channels and feed chambers associated with the pneumatic retraction systems, discussed above with respect to FIGS. 1–4, 9 and 14–16. Typically, club head 613 includes a muzzle portion 631 and a breech portion 633 that are coupled and decoupled as discussed above with respect to FIG. 3. To that end, breech portion 633 includes an annular groove 618 disposed so that shoulder 608 and a portion of first section 606 may travel therethrough until shoulder 608 lies in the same plane as end 612.

Figure 22:
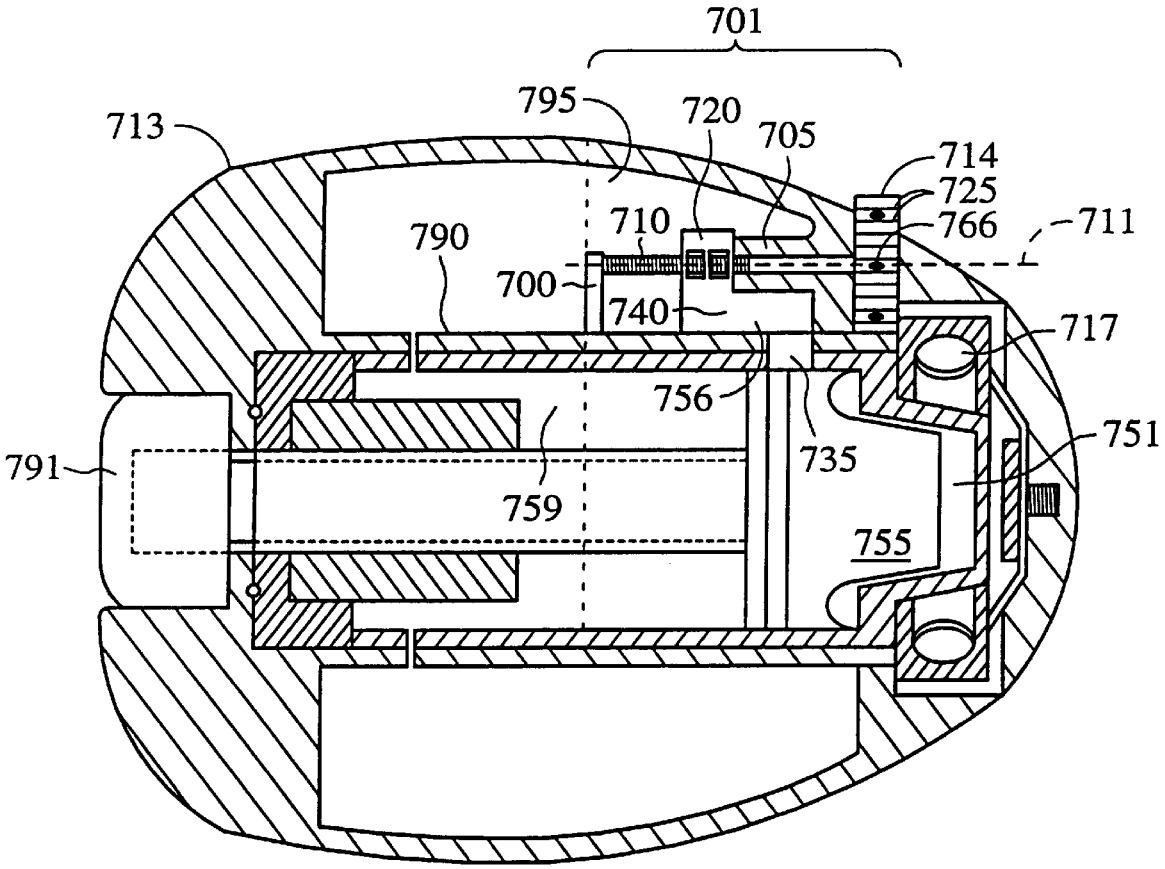
FIG. 22 is a bottom view of a golf club head, in accord with an alternate embodiment in which a range control system is employed.

Referring to FIG. 22, shown is a range control system 701 that may be added to any of the golf club heads shown in the previous figures, shown generally as 713. The range control system 701 comprises of an exhaust chamber 795, a blast chamber 751, a through-port 735 extending therebetween, and a valve disposed proximate to the blast chamber 751. The exhaust chamber is disposed adjacent to the piston cylinder 755 with a wall 790 being disposed therebetween. Through-port 735 is formed through wall 790 and is positioned proximate to blast chamber 751. The through-port 735 defines a cross-sectional area "A" through which fluid may pass between the exhaust chamber 795 and the blast chamber 751. The valve includes a threaded shaft 710 that extends from a thumb-wheel 714, past the through-port 735 and terminates proximate to a stop 700. The stop 700 includes an aperture (not shown). An end of the threaded shaft 710, opposite to the thumb-wheel 714, is rotatably disposed in the stop 700's aperture. In this fashion, the stop 700 and the thumb-wheel 714 are disposed on opposite sides of the through-port 735.

Reciprocally disposed on the threaded shaft 710 is a valve element 756 that includes a journal portion 720 and a hatch portion 740. The journal portion 720 extends transversely to the longitudinal axis 711 of the threaded shaft 710 and includes an opening (not shown) having threads which are complementary to the threads of the shaft 710. The hatch portion 740 extends transversely to the journal portion 720 and parallel to the longitudinal axis 711. The hatch portion 740 is positioned to seat against wall 790 and is disposed to move parallel to longitudinal axis 711 to selectively cover through-port 735.

Specifically, thumb-wheel 714 is disposed in club head 713 so that a portion of the periphery 725 is located exterior to the club head 713. In this manner, the thumb-wheel 714 may be rotated to cause the hatch portion 740 to reciprocate along the longitudinal axis 711 to vary the cross-sectional area "A". The size of cross-sectional area "A" determines that amount of rapidly expanding gas that may exit from blast chamber 751. This reduces the amount of pressure applied to the piston 757, thereby reducing the distance and/or range that a golf-ball would be propelled by the same.

The periphery 725 may include indicia 766 to indicate the relative amount of gas that may exit through cross-sectional area "A". The indicia may include differently colored dots, each of which may be aligned with a site marker (not shown), providing a rough idea of the distance that a golf-ball would be propelled for a given receptacle 717. The thumb-wheel 714 may be adapted to provide discrete changes in dimensions of the cross-sectional area "A". Alternatively, thumb-wheel 714 may be adapted to provide an essentially continuous change in dimensions of the cross-sectional area "A".

Considering that the hatch portion 740 can be subjected to a great deal of fluid pressure, it may be formed from a relatively strong material, such a steel. However, exhaust chamber 795 may be constructed to include a boss 705 though which threaded shaft 710 passes. The boss 705 may be integrally formed with the club head 713 and disposed to extend coextensive with the hatch portion 740, when disposed to completely cover through-port 735. Preferably, one side of the boss 705 is disposed adjacent to the hatch portion 740 so that the hatch portion 740 is wedged between the wall 790 and the boss 705. This provides additional strength to the hatch portion 740, making the same more resistant to deformation from fluid moving into the through-port 735.

Figure 23:
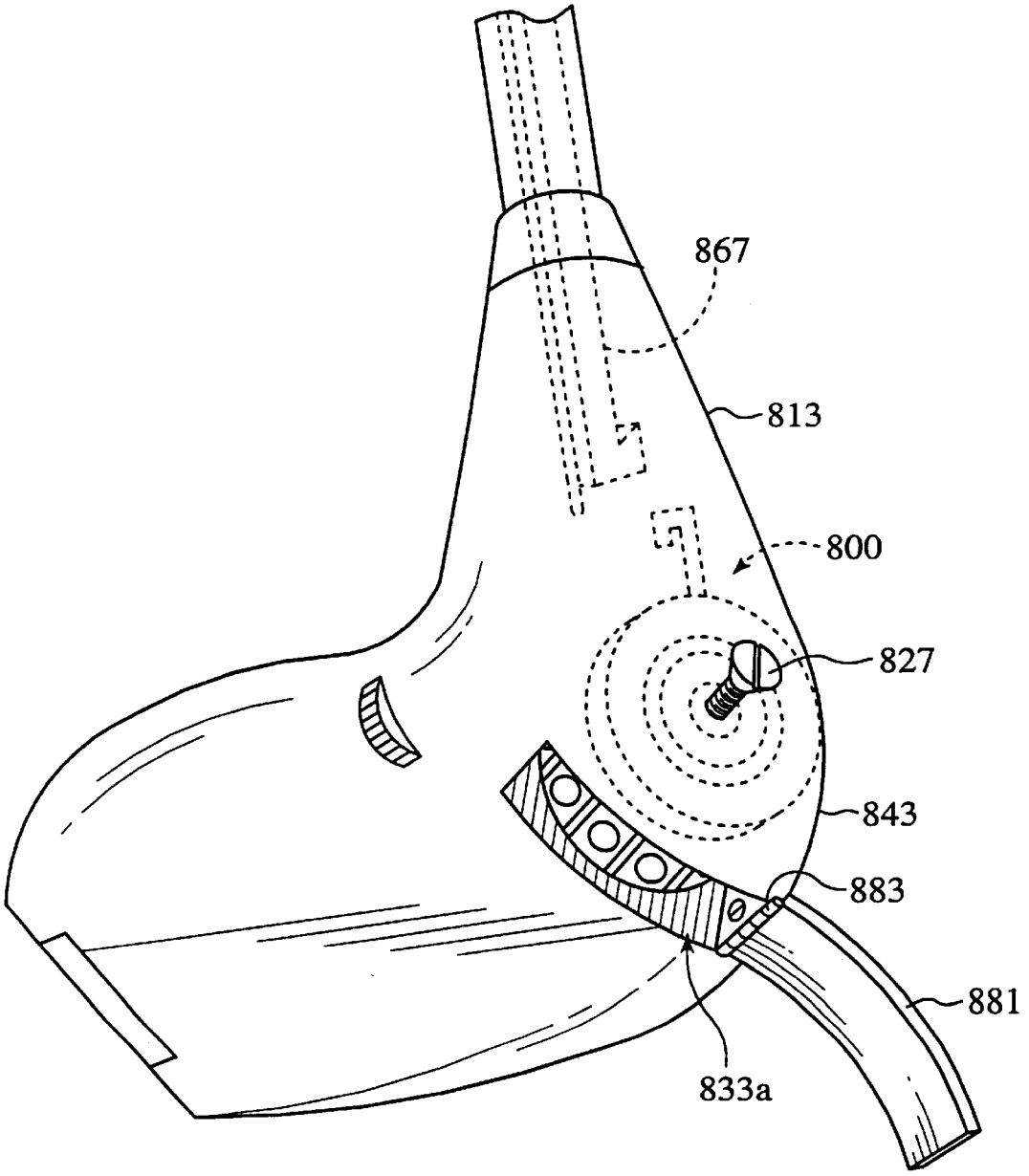
FIG. 23 is a side perspective view of a golf club head in accord with an alternate embodiment in which a cartridge advance mechanism is employed.
Figure 24:
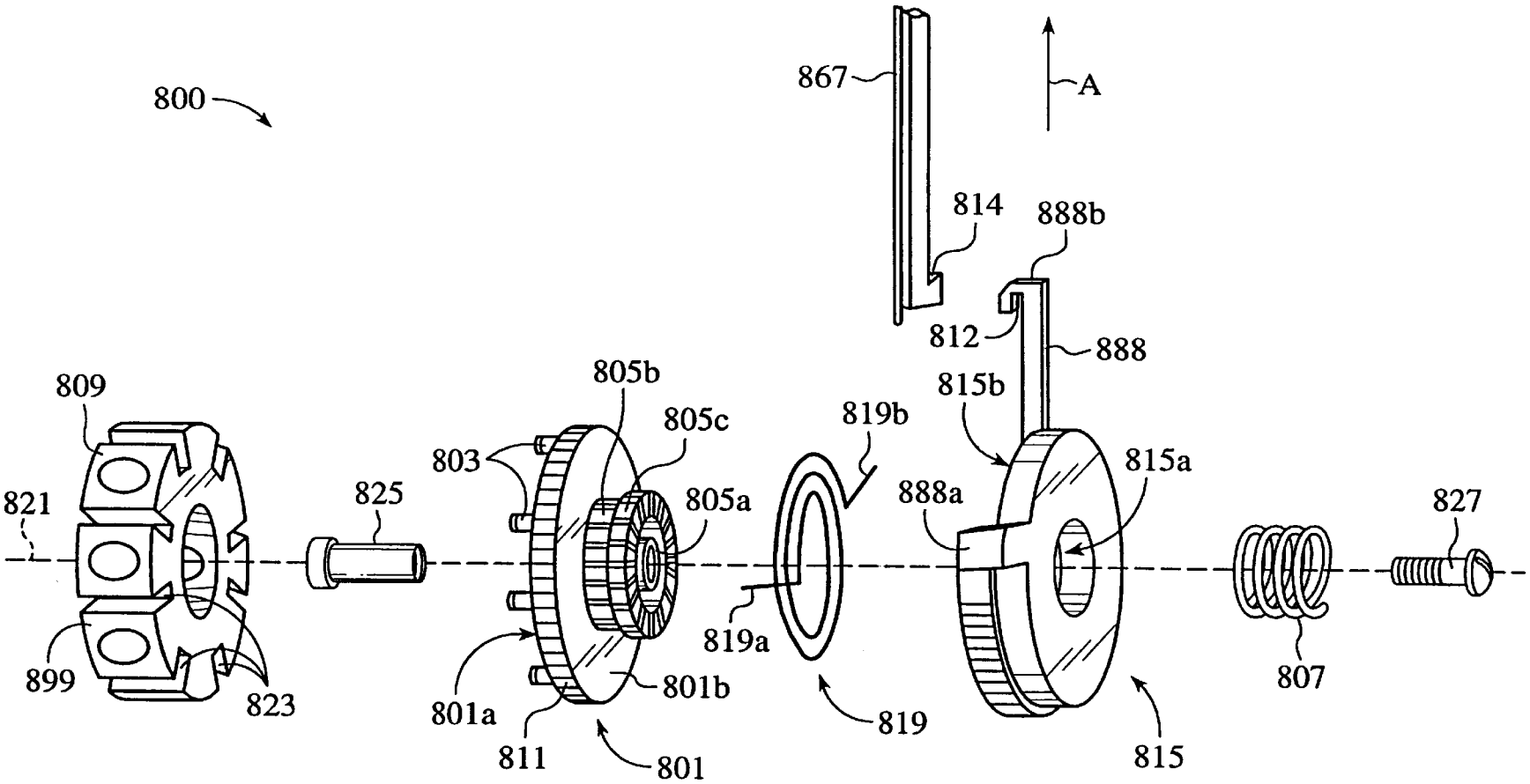
FIG. 24 is an exploded perspective view of the cartridge advance system shown in FIG. 23.
Figure 25:
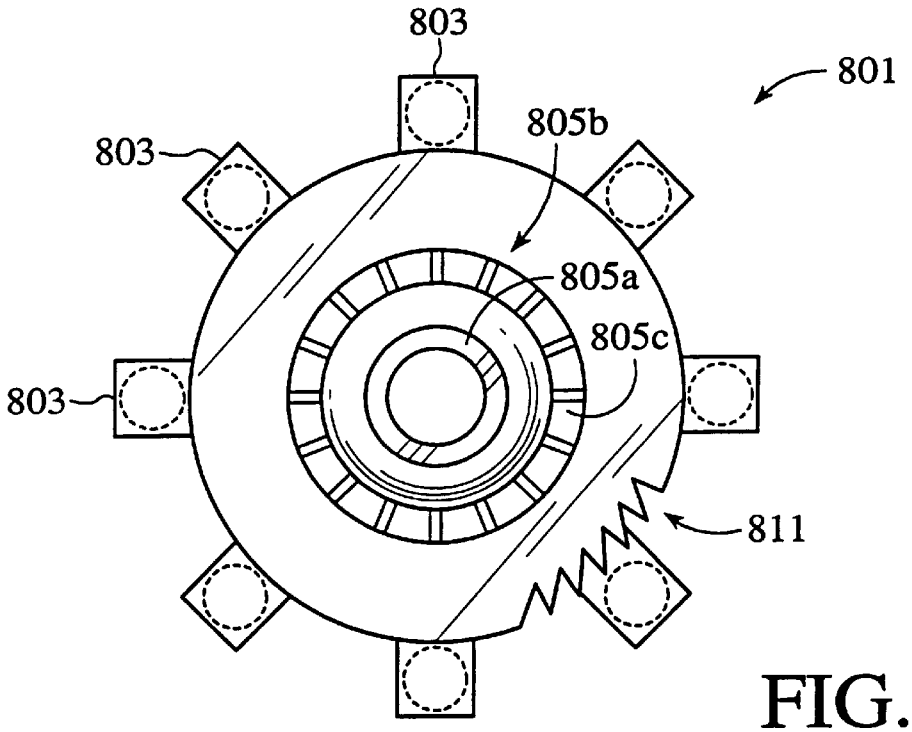
FIG. 25 is a detailed plan view of an advance wheel of the cartridge advance system shown in FIGS. 23 and 24.
Figure 26:
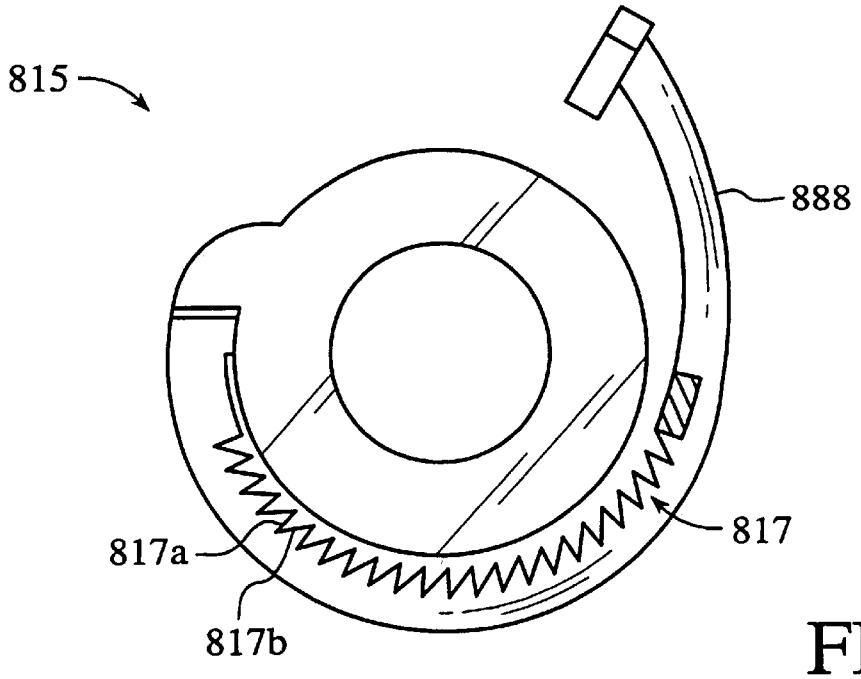
FIG. 26 is a detailed plan view of a lanyard wheel of the cartridge advance system shown in FIGS. 23 and 24.

Referring to FIGS. 23 and 24, a cartridge advance system 800 is shown being disposed within club head 813, proximate to the end 843. The rotor 899 includes a plurality of recesses 823 that are formed into the rotor 899 which are disposed radially symmetric about axis 821. It is preferred, however, that the recesses 823 are in the form of slots that extend from the periphery 809 radially inward, toward axis 821.

Referring to FIGS. 23, 24, 25 and 26, an advance wheel 801 is disposed adjacent to the rotor 899 that has first and second opposed major surfaces 801*a* and 801*b* and a periphery disposed therebetween. A plurality of teeth 811 are formed in the periphery of the advance wheel 801. Extending from the first major surface 801*a* is a plurality of detents 803. Each detent 803 is disposed to fit within one of the recesses 823 and forms an interference fit therewith. Extending from the second major surface 801*b* is a coupling portion that includes two spaced apart cylinders concentrically disposed about axis 821, forming inner 805*a* and outer 805*b* cylinders. The outer cylinder 805*b* extends from the second major surface 801*b* and terminates in an annular ridge 805*c*. A compression spring 807 is disposed between the inner 805*a* and outer 805*b* cylinders.

A lanyard wheel 815 includes a circular opening 815*a*. The lanyard wheel 815 has an annular recess 815*b* and is positioned adjacent to the second major surface 805*b*. In this fashion, the circular opening 815*a* is radially symmetric about the axis 821, with the annular recess 815*b* facing the advance wheel 801. A spring 819 is disposed inside the annular recess 815*b*, between the lanyard wheel 815 and the advance wheel 801, fitting over the outer cylinder 805*b*. One end 819*a* of the spring 819 is fixedly attached to the lanyard wheel 815, with the remaining end 819*b* adapted to be fixedly engaged with the club head 813. To hold the cartridge advance system 800 in place, an aperture is disposed within the end 843, with a screw 827 seated therein to extend along the axis 821. A screw stand-off 825 passes through the inner cylinder 805*a* along the axis 821 and is threaded onto screw 827. In this fashion, the screw 827 and the stand-off 825 secures the cartridge advance system 800 to the club head 813, while allowing rotation of the components about the axis 821.

A flexible lanyard 888 is disposed adjacent to the outer periphery of the lanyard wheel 815, one end 888*a* of which is attached thereto. The remaining end 888*b* of the flexible lanyard 888 terminates in a dove-tailed groove 812. A plurality of teeth 817 are disposed on one side of the flexible lanyard 888 facing the axis 821 so that teeth 817 engage the teeth 811 of advance wheel 801. The opposing sides 817*a* and 817*b* of each tooth 817 are angled so that each tooth 817 forms an interference fit with a tooth 811 in one direction and may slip past one or more teeth 811 in an opposing direction. The firing index pin 867 includes a dove-tailed notch 614 into which the dove-tailed groove 812 is seated.

In operation, firing index pin 867 is retracted along direction a when the club handle (not shown) is cocked. This imparts a rotational force upon the lanyard wheel 815, causing the same to rotate about the axis 821. The teeth 817 are designed so that an interference fit is established between the teeth 811 and the edge 817*a* of each tooth 817, in this direction. The aforementioned interference fit imparts the rotational force upon advance wheel 801, thereby causing the rotor 899 rotor to advance. The length of either the lanyard 888, or the firing index pin 867, dictates the amount of rotational movement of the rotor 899. In this embodiment, the amount of rotation achieved is 45°. Upon rotating the lanyard wheel 815, the return spring 819 is compressed. Upon detonation of a cartridge (not shown) in the rotor 899, the firing index pin 867 moves in a direction opposite to direction A. The lanyard wheel 815 rotates about axis 821 due to the decompression of the return spring 819. The angle of the side edge 817*b* of each tooth 817 allows the lanyard wheel 815 to rotate about axis 821 without causing the advance wheel 801 to undergo corresponding movement. The cartridge advance system 800 abrogates the need to manually align the rotor 899 with the firing index pin 867 for each shot. This facilitates placement of a door 881 on the club head 813 to cover opening 833*a*. The door 881 may be attached to club head 813 via a hinge 883 so that the hinge is not visible upon closing of the door. It is preferred that the door form a flush fit with the outside of the club head 813 so that the club head 813 has a smooth aesthetic appeal.

Figure 27:
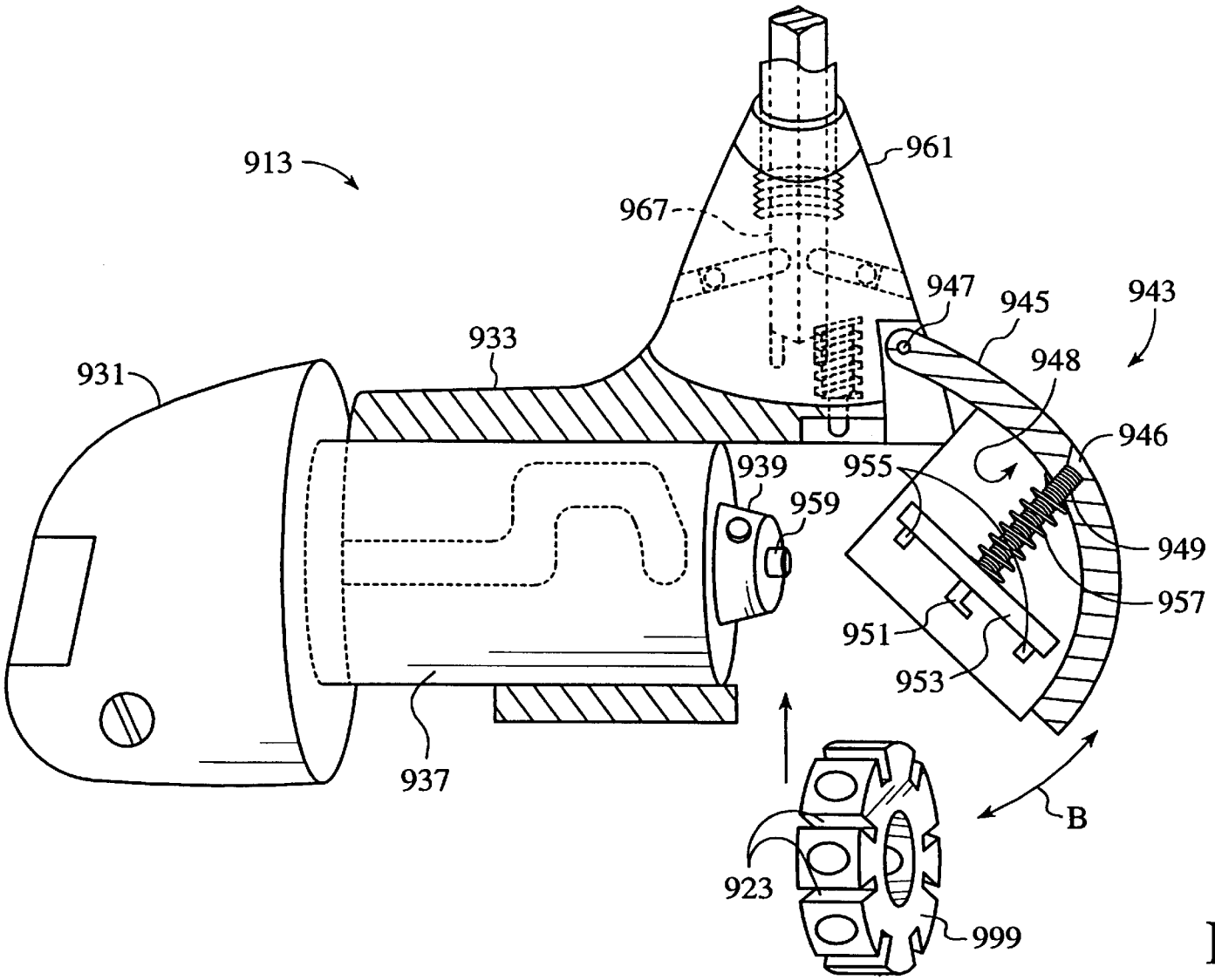
FIG. 27 is a side sectional view showing a club head including a pivoting cover to allow access to the cartridge holder shown in FIGS. 7 and 8.
Figure 28:
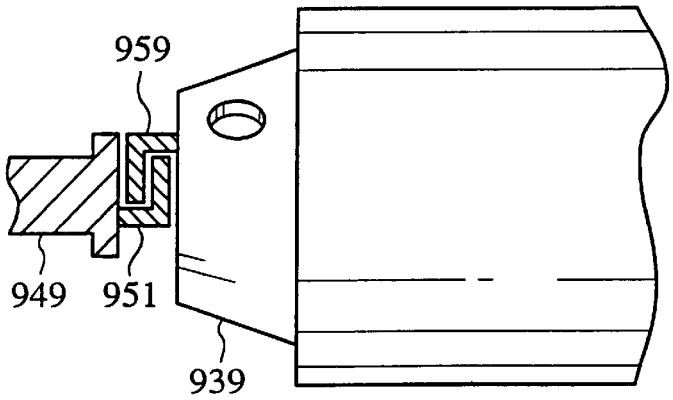
FIG. 28 is a detailed plan view of a coupling mechanism for the pivoting cover shown in FIG. 27.
Figure 29:
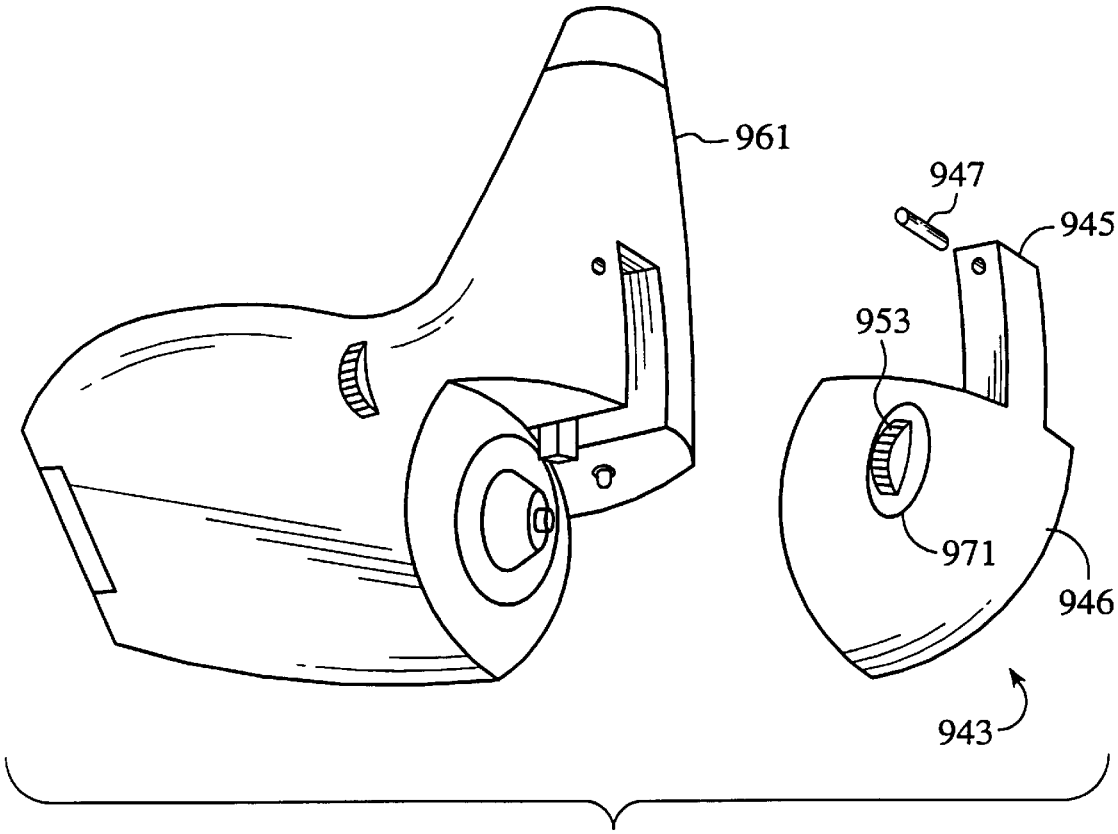
FIG. 29 is an exploded view of the club head shown in FIG. 27.

Finally, referring to FIGS. 27, 28 and 29, the end 943 of the club head 913 may be pivotally attached to the breech portion 933 so as to allow access to the rotor 999. To that end, an upper portion 945, extending into firing pin housing 961, is attached to the breech portion 933 via a pin 947. The lower portion 946 of the end 943 extends coextensive with the cross-sectional area of the breech portion 933 and includes a recess 948. In this fashion, the upper portion 945 is more narrow than the lower portion 946. An axle 949 is disposed in the recess 948 to extend therefrom toward the tapered portion 939, terminating in an L-shaped hook 951. A thumb-wheel 953 is disposed within the recess 948 and mounted to rotate about the axle 949. The thumb-wheel 953 includes a plurality of cogs 955 that extend toward the tapered portion 939. The cogs 955 are positioned on the thumb-wheel 953 so as to be received within a recess 923 of the rotor, upon the end 943 reaching a final seating position, discussed more fully below. A spring 957 is positioned between the thumb-wheel 953 and the end 943, with the axle 949 passing through the center of the spring 957. The tapered portion 939 includes an L-shaped hook 959 that extends toward the end 943.

Figure 30:
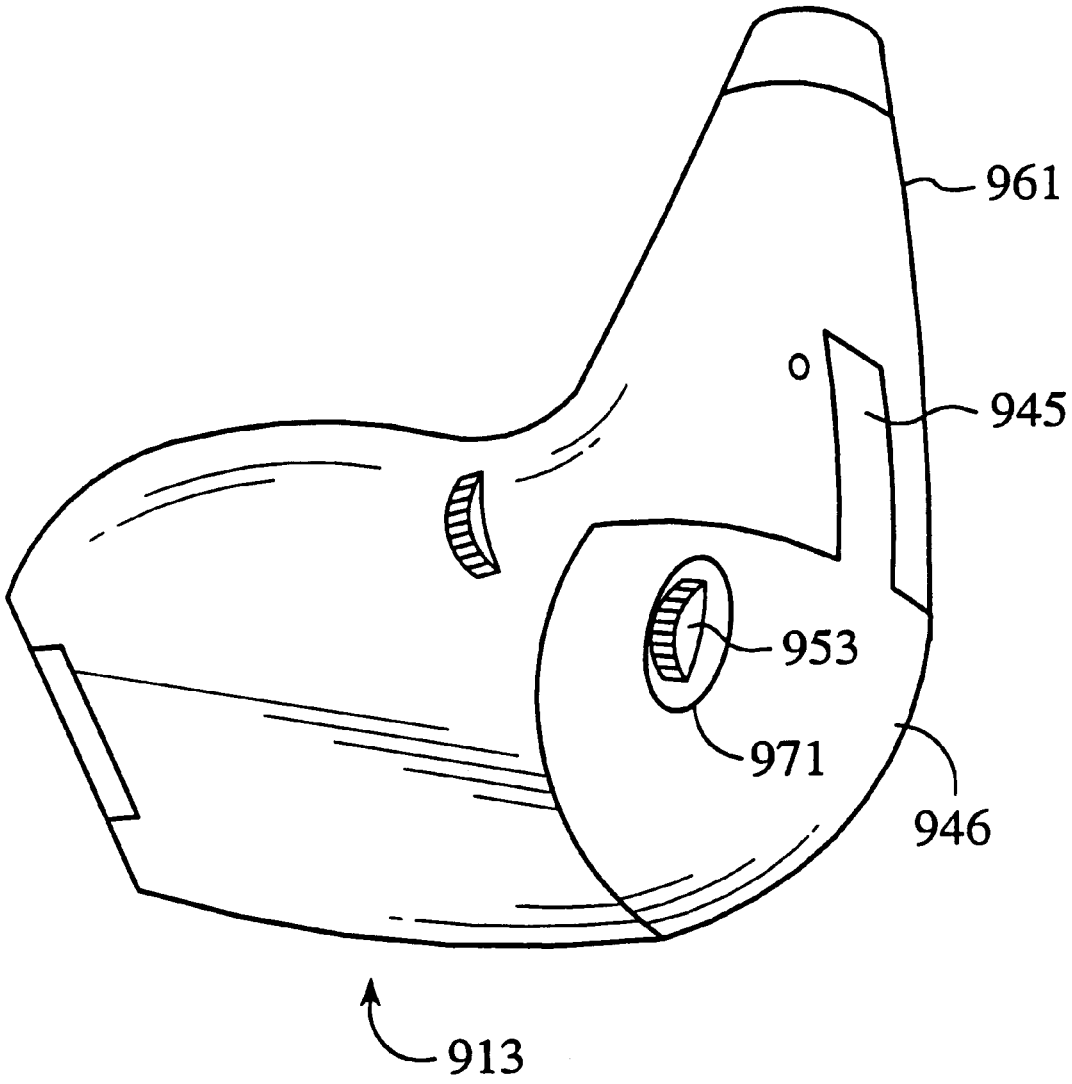
FIG. 30 is a perspective view of the club head shown in FIG. 29, with the door disposed in a final seating position.

Referring to FIGS. 27, 28 and 30, in a final seating position the rotor 999 fits onto tapered portion 939 with the L-shaped hooks 951 and 959 coupled together, and each of the cogs 955 is received in one of the recesses 923 of the rotor 999. With the end 943 placed in the final seating position, the outside of the club head 913 has a smooth appearance, excepting for a dimple 971 formed therein proximate to the thumb-wheel 953. This allows a portion of the thumb-wheel 953 to extend beyond the surface of the club-head 913.

The end 943 is held in place by the coupling of the two L-shaped hooks 951 and 959. To rotate the end 943 away from the breech portion 933, the muzzle portion 931 of the club head 913 is rotated. Specifically, the muzzle portion 931 is rotated so that the two L-shaped hooks 951 and 959 decouple. This allows the end 943 to rotate about the pin 947 in a direction shown by arrow B, allowing the rotor 999 to be removed from the tapered portion 939. As an added safety feature, the firing index pin 967 may include a shoulder positioned to rest against the upper portion 945 when the end 943 is in an opened position. In this manner, an unintentional discharge is avoided.

Figure 31:
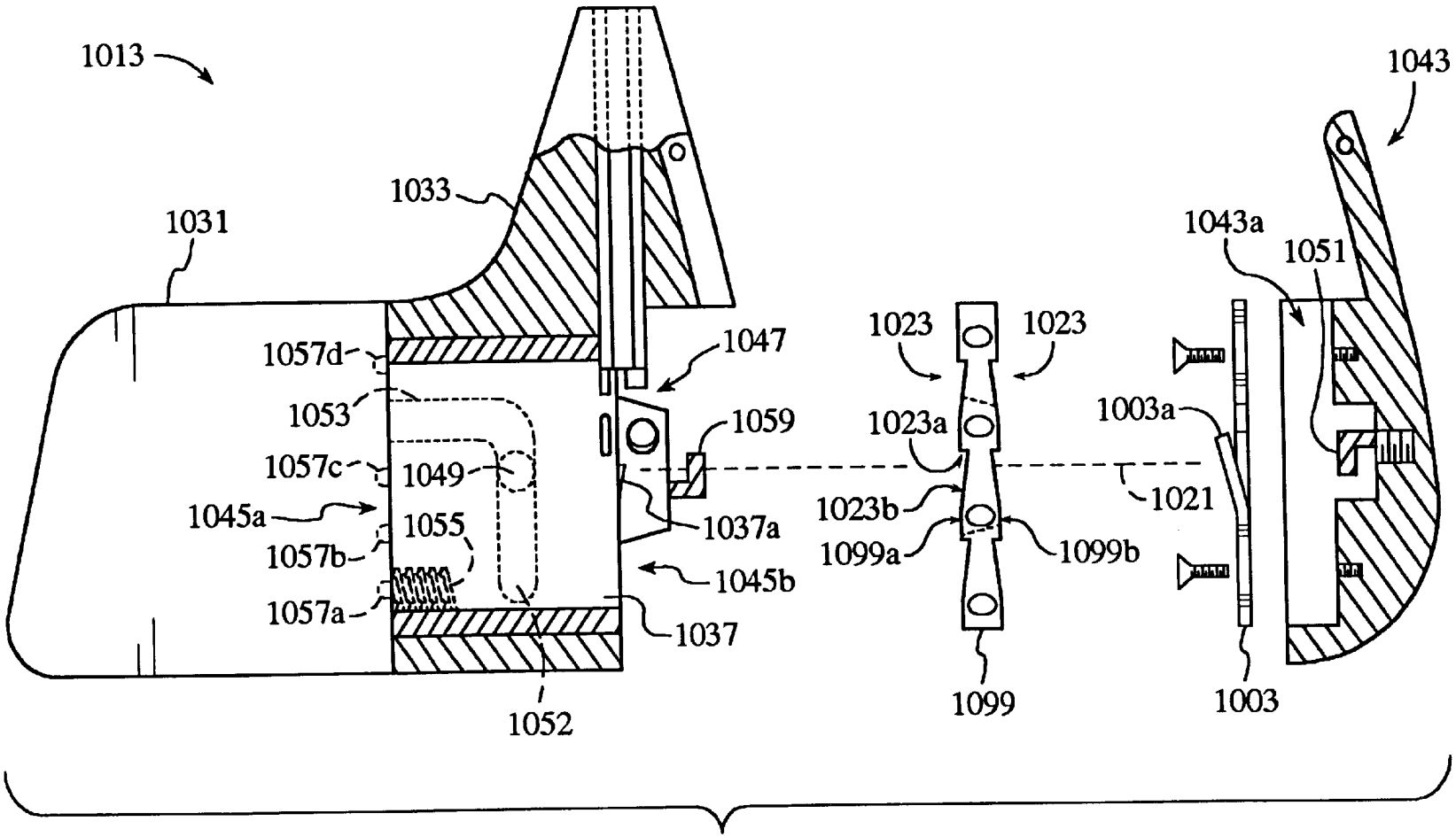
FIG. 31 is a side cross-sectional exploded view of the club head in accord with an alternate embodiment.

Referring to FIG. 31, another embodiment of the cartridge advance system employed in club head 1013 that may incorporate the features shown above in FIGS. 1–13. The cartridge advance system shown in FIG. 31 includes, as before, rotor 1099 having a plurality of recesses 1023 disposed radially and symmetrically about spin axis 1021. However, unlike rotor 899, discussed above with respect to FIGS. 23 and 24, rotor 1099, shown in FIG. 31, has recesses formed into at least one of the opposed major surfaces 1099*a* and 1099*b*. It is preferred that recesses 1023 be formed in both of the major surfaces 1099*a* and 1099*b*. Each of the recesses 1023 defines first and second surfaces 1023*a* and 1023*b*. First surface 1023*a* lies in a plane that extends parallel to the axis 1021 of rotation. Second surface 1023*b* extends transversely to the axis of rotation 1021 and lies in a plane that extends obliquely to the first surface 1023*a*.

End 1043 of club head 1013 is pivotally attached to the breech portion 1033 as discussed above with respect to FIG.

27. In this fashion, breech portion 1033 defines a chamber having two spaced-apart openings 1045*a* and 1045*b*. Muzzle portion 1031 has a housing 1037 which extends into chamber 1047 from opening 1045*a,* terminating in a detent 1037*a* disposed proximate to opening 1045*b*. Although the housing may include any number of detents 1037*a,* it is preferred that there are two spaced-apart detents 1037*a* disposed on opposite sides of the axis of rotation 1021. Upon reaching a final seating position, one of the major surfaces 1099*a* or 1099*b* of the rotor 1099 faces the housing 1037, with detents 1037*a* being disposed in two different recesses 1023. To facilitate the interlocking engagement of the rotor 1099 with the detents 1037*a,* each of the detents 1037*a* have a shape complementary to the shape of the recesses 1023. In this fashion, each of the detents 1037*a* forms an interference fit with a recess 1023 in one direction and is slidable engaged with the rotor 1099 in an opposing direction. The detents 1037*a* imparts rotational movement of the rotor 1099, about spin axis 1021, in only one direction. The detents 1037*a* slip past one or more recess 1023 in an opposing direction without imparting any rotational movement thereupon. The detents 1037*a* may be integrally formed with the hosing or, alternatively, may be a protrusion from a spring as discussed below with resepct to spring 1003.

Figure 32:
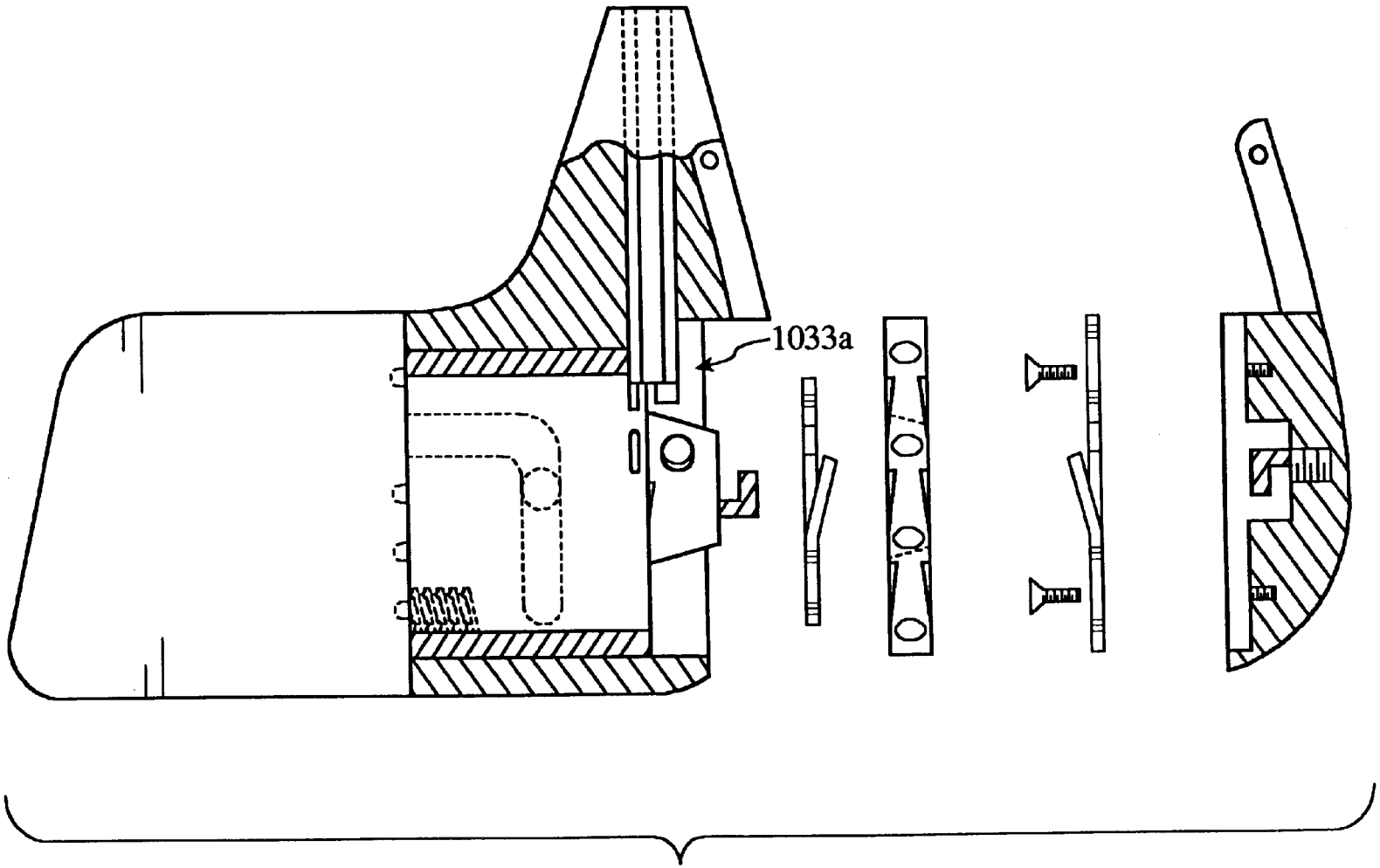
FIG. 32 is a cross-sectional exploded view of the club head shown in FIG. 31 in accord with an alternate embodiment.

Rotor 1099 is held firmly against the detents 1037*a* under force of a spring 1003 attached to an interior surface of end 1043. Although any shaped spring may be employed, it is preferred that spring 1003 have a pair of spaced apart protrusions 1003*a* that have a shape complementary to the shape of the recesses 1023. In this fashion, the protrusions 1003*a* may be disposed in two of the recesses 1023, and function in the same manner as detents 1037*a*. To wedge the rotor 1099 between detents 1037*a* and spring 1003, an L-shaped hook 1059 is centered between detents 1037*a* and extends from the housing 1037 passing through rotor 1099. The spring includes a central aperture (not shown) disposed opposite to an L-shaped hook 1051 protrudes from the interior wall of the end 1043. The L-shaped hook 1059 extends through the central aperture (not shown) allowing the same to couple with L-shaped hook 1051. The spring 1003 presses against the rotor 1099, upon the end 1043 reaching a final seating position in which the two L-shaped hooks 1051 and 1059 are in interlocking engagement. In this fashion, spring 1003 wedges the rotor 1099 onto tapered portion 1039, providing the benefits discussed above. To facilitate housing of the rotor 1099 within the club head 1013, the end 1043 may be hollowed-out forming a void 1043*a* in which the rotor may be located when the end 1043 has reached a final seating position. Alternatively, the breech portion may be hollowed-out forming a void 1033*a,* shown in FIG. 32, in which the rotor 1099 will be located upon the closed end 1043 reaching a final seating position.

Referring again to FIG. 31, in operation, rotation of rotor 1099 is accomplished by rotating muzzle portion 1031 with respect to breech portion 1033. Rotation of muzzle portion 1031 causes the detents 1037*a* to engage surface 1023*a*. As shown rotation of rotor 1099 occurs upon rotating muzzle portion 1031 clockwise. However, over-rotation of muzzle portion 1031 would cause decoupling of the muzzle portion 1031 from the breech portion 1033. To prevent unintentional decoupling, A rotation indicator is included into the club head 1013 that includes an resiliently biased ball-bearing 1055 coupled to the breech portion 1033 to wedge against the muzzle portion 1031. The muzzle portion 1031 includes a plurality of indents 1057*a,* 1057*b,* 1057*c* and 1057*d*. Each of the indents 1057*a,* 1057*b,* 1057*c* and 1057*d* is adapted to receive the ball bearing 1055 when the club head 1013 is in a predetermined position.

For example, with ball bearing 1055 disposed in indent 1057*a,* the muzzle and breech portions 1031 and 1033 are securely fastened together, and the club head 1013 is prepared for firing. When ball bearing 1055 is disposed in indent 1057*b,* the muzzle portion has been rotated ⅛ revolution, i.e., 45°, with respect to the breech portion 1033. Rotating the muzzle portion 1031 ⅛ revolution causes each detent 1037*a* to slip past a recess 1023 so as to engage the surface 1023*a* of an adjacent recess 1023, while protrusions 1003*a* form an interference fit with recesses 1023. Thereafter, by rotating the muzzle portion 1031 back to indent 1057*a,* the detents 1037*a* form an interference fit with recesses 1023 causing rotor 1099 to spin about axis 1021. In this fashion, successive cartridges (not shown) disposed in the ducts 1005 of the rotor may be aligned to allow being struck by the firing pin 1069.

Upon rotating the muzzle portion 1031 ½ revolution clockwise, the L-shaped hooks 1051 and 1059 become disengaged, allowing end 1043 to pivot away from rotor 1099. Rotating muzzle portion counter-clockwise ½ revolution so that resiliently biased ball bearing 1055 is disposed in indent 1057*d,* the muzzle portion 1031 may be decoupled from the breech portion 1033. To facilitate rotational movement between the muzzle portion 1031 and the breech portion 1033 the detent 1049 is spaced apart from the stop 1052 of the groove 1053 a sufficient amount of distance to allow at least ½ revolution of movement between the muzzle portion 1031 and the breech portion 1033.

What is claimed is:

1. A cartridge holder for a golf club, said cartridge holder comprising:

a body having a periphery surface and a cavity formed about an axis of symmetry, defining an inner surface disposed opposite to said periphery surface, said body having a duct formed therein, said duct extending along a longitudinal axis transversely to said axis of symmetry between an opening formed in said periphery surface and an orifice formed in said inner surface.

2. The cartridge holder as recited in claim 1 wherein said body has first and second opposed major surfaces, each of which extends transversely to said periphery surface, with said inner surface forming an oblique angle with respect to said first and second opposed major surface.

3. The cartridge holder as recited in claim 1 wherein a plurality of ducts are formed therein and disposed radially symmetrically about said axis of symmetry.

4. The cartridge holder as recited in claim 1 wherein said periphery surface is recessed in an area surrounding said opening.

5. The cartridge holder as recited in claim 1 wherein said cartridge holder has, formed into said periphery surface, a dimple disposed spaced-apart from said opening.

6. The cartridge holder as recited in claim 1 wherein said body includes opposed major surfaces, each of which extends transversely to said periphery surface, with one of said opposed major surface including a recess.

7. The cartridge holder as recited in claim 1 wherein said body includes opposed major surfaces, each of which extends transversely to said periphery surface, with one of said opposed major surfaces including a pair of recesses disposed on opposite sides of said axis of symmetry.

8. The cartridge holder as recited in claim 1 wherein said central cavity is disposed radially symmetrically about said axis of symmetry, with said body further including opposed major surfaces, each of which extends transversely to said periphery surface, with one of said opposed major surfaces including a recess, said recess having first and second surfaces, with said first surface lying in a plane extending parallel to said axis of symmetry and said second surface extending transversely thereto.

9. The cartridge holder as recited in claim 1 wherein said body includes opposed major surfaces, each of which is planar and extends transversely to said periphery surface.

10. The cartridge holder as recited in claim 1 wherein said inner surface tapers.

11. The golf club as recited in claim 10 wherein said duct has a cylindrical shape having a diameter associated therewith, said diameter varying along said longitudinal axis.

12. A cartridge holder for a golf club, said cartridge holder comprising:

a body having a periphery surface and a cavity, formed about an axis of symmetry, defining an inner surface disposed opposite to said periphery surface, said body having a plurality of ducts formed therein and disposed radially symmetrically about said axis of symmetry, with each of said plurality of ducts extending along a longitudinal axis transversely to said axis of symmetry between an opening formed in said periphery surface, defining a plurality of openings, and an orifice formed in said inner surface, with regions of said periphery disposed proximate to said plurality of openings being recessed.

13. The cartridge holder as recited in claim 12 wherein said body has first and second opposed major surfaces, each of which extends transversely to said periphery surface.

14. The cartridge holder as recited in claim 13 wherein said inner surface forms an oblique angle with respect to said first and second opposed major surfaces.

15. The cartridge holder as recited in claim 14 wherein said cartridge holder has formed into said periphery surface a plurality of dimples, each of which is disposed between adjacent openings of said plurality of openings.

16. The cartridge holder as recited in claim 14 wherein said body includes opposed major surfaces, each of which extends transversely to said periphery surface, with each of said opposed major surface including a plurality of recesses disposed radially symmetric about said axis of symmetry.

17. The cartridge holder as recited in claim 16 wherein each of said plurality of recesses includes first and second surfaces, with said first surface lying in a plane extending parallel to said axis of symmetry and said second surface extending transversely thereto with said cavity being formed radially symmetrically about said axis of symmetry.

18. A cartridge holder for a golf club, said cartridge holder, comprising:

a body having a periphery surface and a central cavity, formed radially and symmetrically about an axis of symmetry, defining an inner surface disposed opposite to said periphery surface, said body having a plurality of ducts formed therein and disposed radially symmetric about said axis of symmetry, with each of said plurality of ducts extending along a longitudinal axis extending transversely to said axis of symmetry between an opening formed in said periphery surface, defining a plurality of openings, and an orifice formed in said inner surface, with regions of said periphery disposed proximate to said plurality of openings being recessed.

19. The cartridge holder as recited in claim 18 wherein central cavity is tapered.

20. The cartridge holder as recited in claim 19 wherein said body has first and second opposed major surfaces, each of which extends transversely to said periphery surface and includes a plurality of recess disposed radially symmetric about said axis of symmetry with each of said plurality of recesses including first and second surfaces, with said first surface lying in a plane extending parallel to said axis of symmetry and said second surface extending transversely thereto.

* * * * *